US008403577B2

(12) United States Patent
Khoshnevis

(10) Patent No.: US 8,403,577 B2
(45) Date of Patent: Mar. 26, 2013

(54) MULTICOLOR WRITING AND PAINTING INSTRUMENTS WITH MULTIPLE, BUNDLED, HARD, WEAR-RESISTANT NIBS

(75) Inventor: Behrokh Khoshnevis, Marina del Rey, CA (US)

(73) Assignee: University of Southern California, Los Angeles, CA (US)

( * ) Notice: Subject to any disclaimer, the term of this patent is extended or adjusted under 35 U.S.C. 154(b) by 1018 days.

(21) Appl. No.: 12/333,603

(22) Filed: Dec. 12, 2008

(65) Prior Publication Data

US 2009/0154982 A1 Jun. 18, 2009

Related U.S. Application Data

(60) Provisional application No. 61/013,071, filed on Dec. 12, 2007, provisional application No. 61/040,588, filed on Mar. 28, 2008.

(51) Int. Cl.
*B43K 27/04* (2006.01)

(52) U.S. Cl. ..... 401/35

(58) Field of Classification Search ..... 401/34, 401/35, 16, 22

See application file for complete search history.

(56) References Cited

U.S. PATENT DOCUMENTS

| | | | |
|---|---|---|---|
| 396,547 A | 1/1889 | De Normanville | |
| 1,938,835 A | 12/1933 | Grzb | |
| 2,130,978 A | 9/1938 | White | |
| 2,192,479 A | 3/1940 | Nissen, Jr. | |
| 2,228,235 A | 1/1941 | Pfanstiehl | |
| 2,608,953 A | 9/1952 | Kollsman | |
| 2,684,052 A | 7/1954 | Rickmeyer | |
| 2,938,499 A | 5/1960 | Lindenbaum | |
| 3,290,717 A | 12/1966 | Mizutani | |
| 3,348,235 A | 10/1967 | Kawase et al. | |
| 3,705,774 A | 12/1972 | Kranich | |
| 3,887,287 A | 6/1975 | Rosh, Jr. | |
| 4,529,329 A | 7/1985 | Hirabayashi et al. | |
| 4,692,046 A * | 9/1987 | Lan | 401/32 |

(Continued)

FOREIGN PATENT DOCUMENTS

| | | |
|---|---|---|
| JP | S29-5216 | 5/1954 |
| JP | S56-50687 | 5/1981 |

OTHER PUBLICATIONS

Office Action, dated Aug. 19, 2010, for U.S. Appl. No. 12/333,614, filed Dec. 12, 2008, entitled "Multicolor Writing and Painting Instruments with Single Nib Fed With User-Selected Colored Ink."

(Continued)

*Primary Examiner* — Huyen Le
(74) *Attorney, Agent, or Firm* — McDermott Will & Emery LLP

(57) ABSTRACT

A multicolor writing and painting instrument may include a plurality of hard, wear-resistant nibs at an end of the tubular housing. Each nib may have a tip. The nibs may be bundled together such that the tips of the nibs lie in substantially the same plane and approximately on the circumference of a common circle. The instrument may include an ink reservoir for each of the nibs within the tubular housing. Each ink reservoir may be configured to hold a colored ink. The instrument may include a single, hard, wear-resistant nib at an end of the tubular housing. The nib may have a writing surface. A plurality of tubes may each lead to the writing surface of the nib. The tubes may form a plurality of openings on the writing surface. The openings may be arranged in clusters of one or more openings. Each cluster of openings may lie approximately along a circumference of a common circle. There may be a separate ink reservoir within the tubular housing for each cluster of openings.

17 Claims, 21 Drawing Sheets

U.S. PATENT DOCUMENTS

| | | | | |
|---|---|---|---|---|
| 4,748,460 | A | | 5/1988 | Piatt et al. |
| 5,238,320 | A | | 8/1993 | Komatsu et al. |
| 5,440,327 | A | * | 8/1995 | Stevens ..... 346/46 |
| 5,443,322 | A | | 8/1995 | Jozat et al. |
| 5,599,122 | A | | 2/1997 | Yu |
| 5,911,533 | A | | 6/1999 | Fassier et al. |
| 6,464,107 | B1 | | 10/2002 | Brugger |
| 6,474,888 | B1 | | 11/2002 | Lapstun et al. |
| 6,739,779 | B1 | | 5/2004 | Deeds |
| 6,749,355 | B2 | | 6/2004 | Payne et al. |
| 7,018,122 | B2 | | 3/2006 | Kwan et al. |
| 7,683,895 | B2 | | 3/2010 | Mika |
| 2004/0001737 | A1 | | 1/2004 | Giron |
| 2006/0244805 | A1 | | 11/2006 | Yeh |
| 2009/0154983 | A1 | | 6/2009 | Khoshnevis |

OTHER PUBLICATIONS

Office Action, dated Apr. 5, 2011, for U.S. Appl. No. 12/333,614, filed Dec. 12, 2008, entitled "Multicolor Writing and Painting Instruments with Single Nib Fed With User-Selected Colored Ink."

International Search Report for PCT Application Serial No. PCT/US08/86577, mailed on Feb. 12, 2009.

* cited by examiner

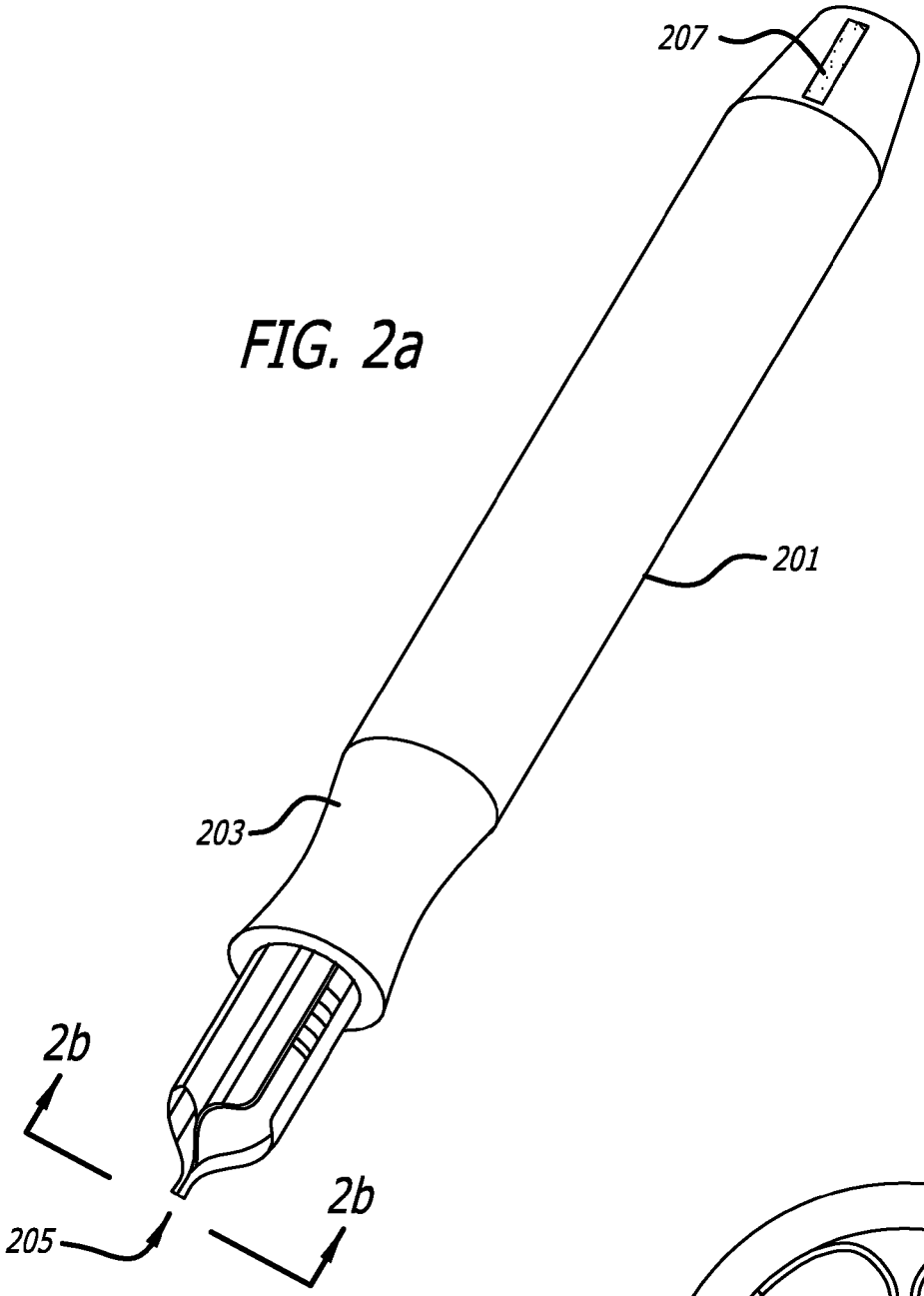
FIG. 2a
FIG. 2b
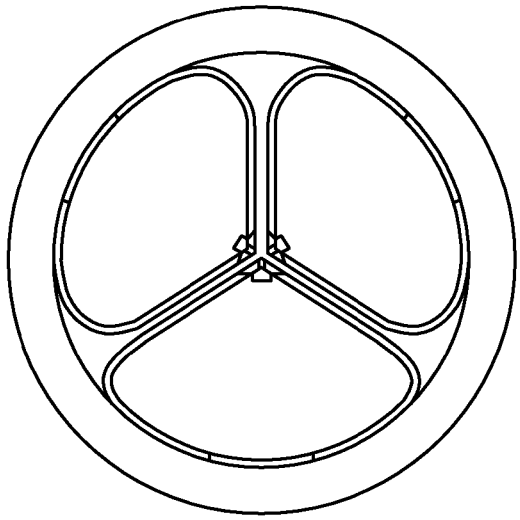

FIG. 7a
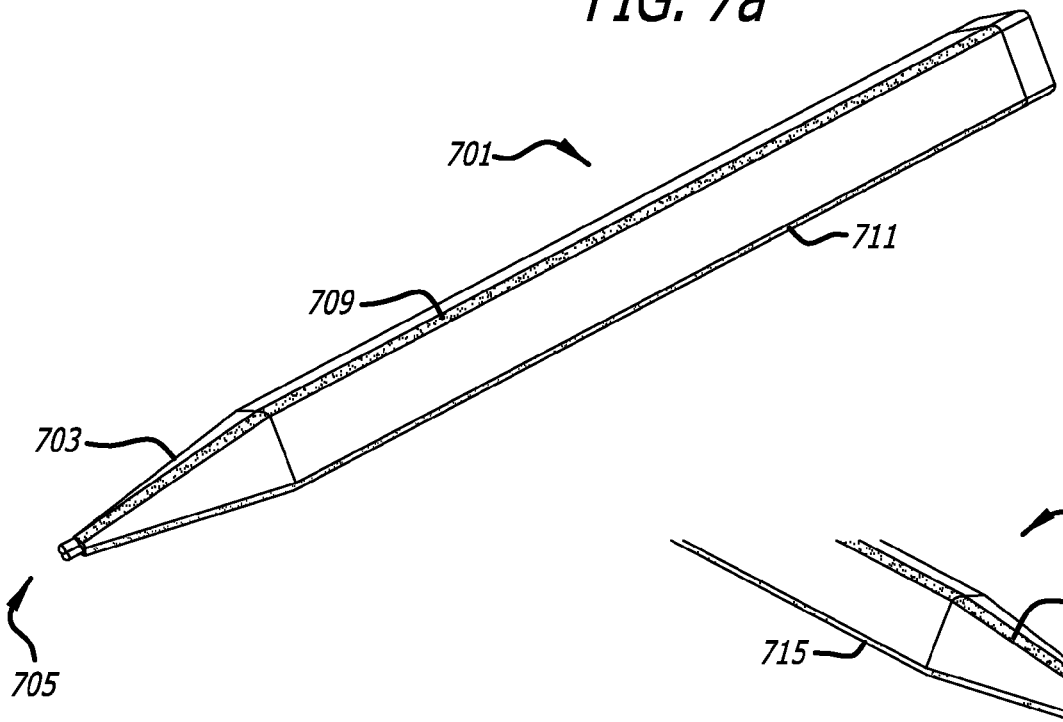
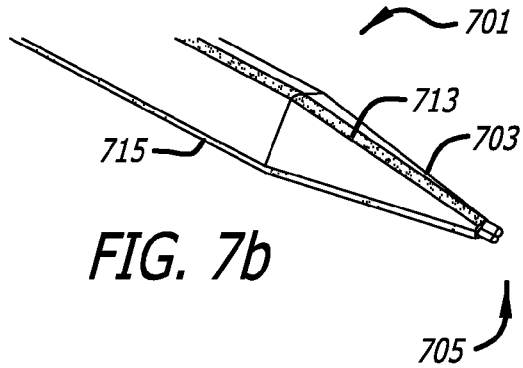
FIG. 7b
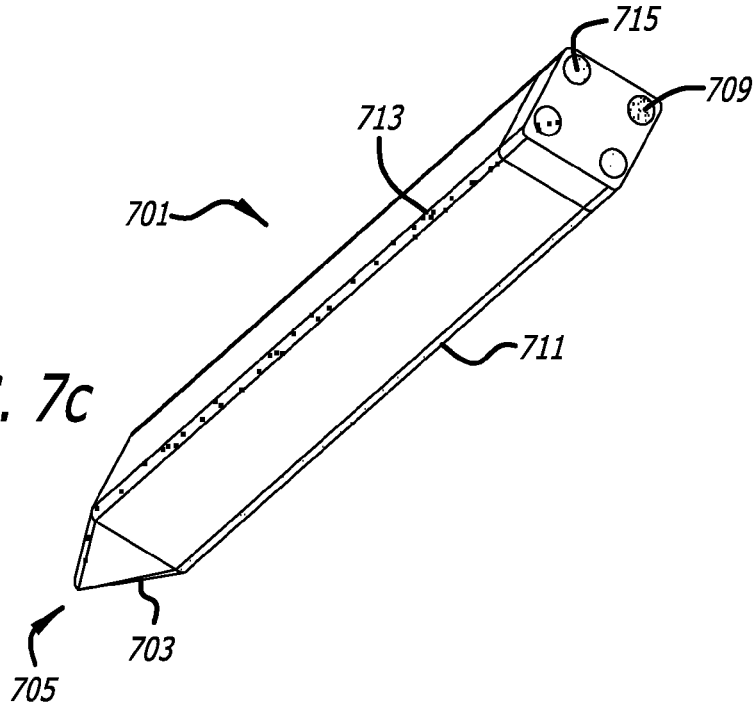
FIG. 7c

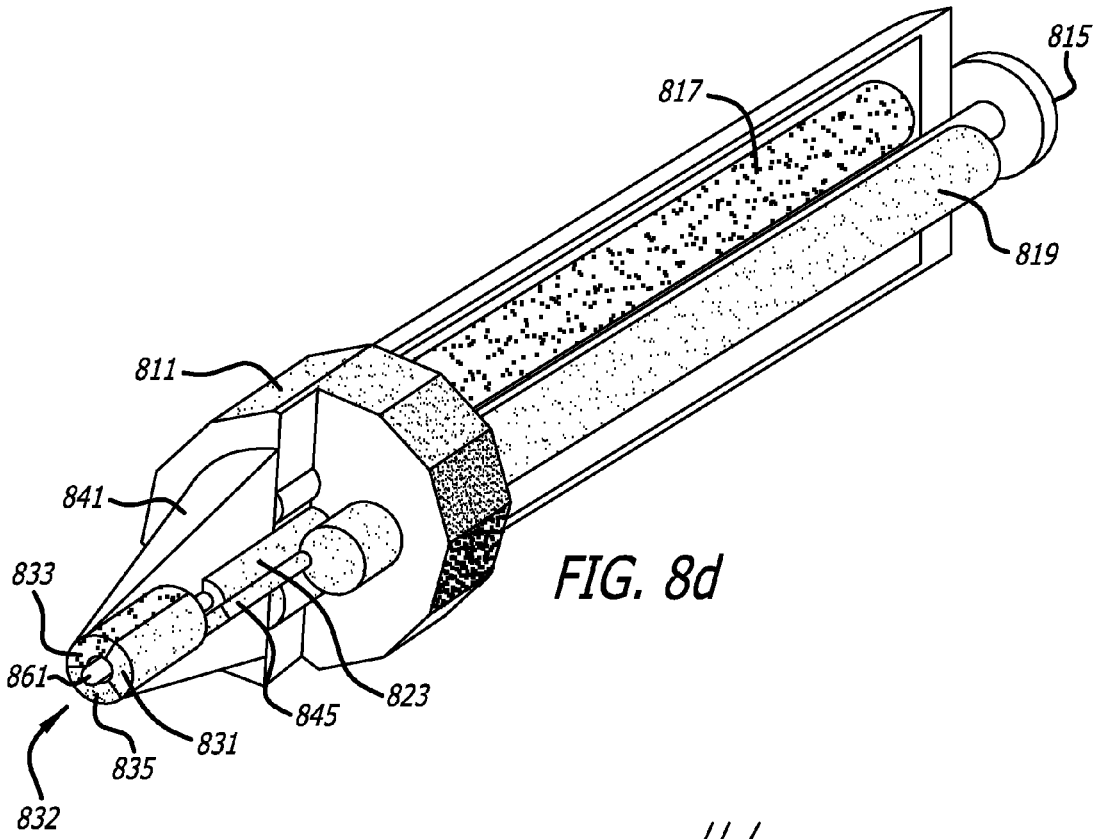
FIG. 8d
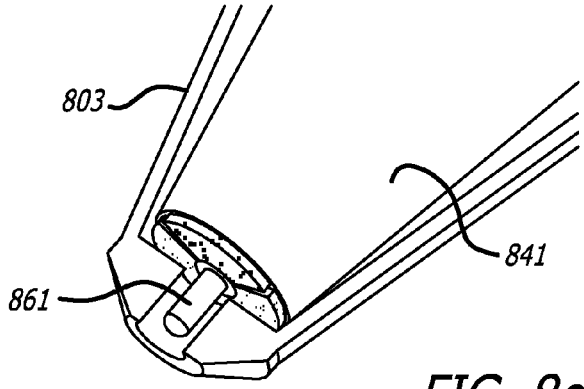
FIG. 8e
FIG. 8f
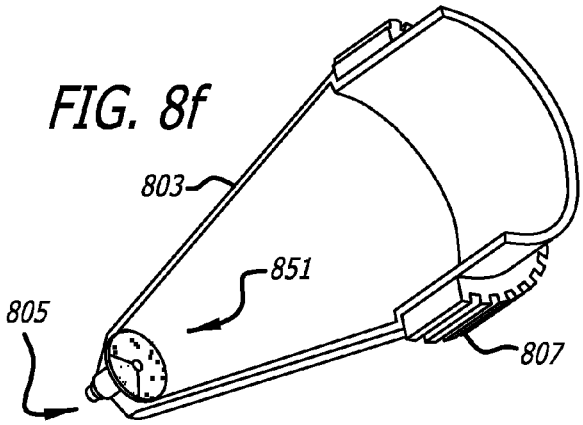

MULTICOLOR WRITING AND PAINTING INSTRUMENTS WITH MULTIPLE, BUNDLED, HARD, WEAR-RESISTANT NIBS

CROSS-REFERENCE TO RELATED APPLICATION(S)

This application is based upon and claims priority to U.S. Provisional Patent Application number U.S. Patent Application Ser. No. 61/013,071, entitled "MULTICOLOR PENS AND PAINTING INSTRUMENTS," filed Dec. 12, 2007, and U.S. Patent Application Ser. No. 61/040,588, entitled "MULTICOLOR WRITING AND PAINTING INSTRUMENTS," filed Mar. 28, 2008. The entire content of both applications is incorporated herein by reference.

STATEMENT REGARDING FEDERALLY SPONSORED RESEARCH

Not Applicable

NAMES OF PARTIES TO JOINT RESEARCH AGREEMENT

Not Applicable

REFERENCE TO APPENDIX

Not Applicable

BACKGROUND

1. Technical Field

This application relates to writing and painting instruments, including writing and painting instruments that write and paint in different colors.

2. Description of Related Art

People frequently write and paint (hereinafter collectively "write") in more than one color. For example, people may draft a document in one color and mark needed changes in a different color. People may also use color to provide emphasis. To do so, however, they may need to pick up one instrument which writes in one color, write with that instrument, put it down, pick up a different instrument which writes in the other color, write with that instrument, put it down, and repeat this process throughout their effort. This may waste time, be inconvenient, and require multiple writing instruments to be purchased, stored, and carried. Different-colored writing instruments may not even always be available. This may diminish the effectiveness of the writings that are produced.

Different colored pens have been placed within a single housing. Buttons or other mechanical devices allow the user to selectively move the nib from just one of these colored pens into the writing position. When a color change is desired, however, the person must usually stop writing, lift the instrument from the writing surface, manipulate the mechanical device to make the change, and reposition the instrument back on the writing surface. Such pens may also be limited in the colors which they can provide.

Another approach was set forth in U.S. Pat. No. 7,018,122. Different colored inks were simultaneously delivered to a tri-sectioned nib made from fibrous material. The user changed color merely by rotating the writing instrument. However, this fibrous nib may not wear evenly which may result in a short useful product life. This instrument also appears to have been limited in the colors which it can provide.

SUMMARY

A multicolor writing and painting instrument may include a tubular housing sized and shaped to be held by fingers of a user. The instrument may include a plurality of hard, wear-resistant nibs at an end of the tubular housing. Each nib may have a tip. The nibs may be bundled together such that the tips of the nibs lie in substantially the same plane and approximately on the circumference of a common circle. The instrument may include an ink reservoir for each of the nibs within the tubular housing. Each ink reservoir may be configured to hold a colored ink. The instrument may include a fluid delivery system within the tubular housing for each of the nibs. Each fluid delivery system may be connected between one of the nibs and the ink reservoir for that nib and configured to deliver fluid from that reservoir to that nib.

The ink reservoirs may each contain a different colored ink. The different colors may include red, blue and black.

Each nib may be made of a hard metal.

Each nib may include a roller ball. Each roller ball may be a needle roller ball.

The instrument may include color selection indicia on the surface of the tubular housing that is configured to communicate to the user the color the instrument is positioned to write.

The color selection indicia may include a color selection indicia for each nib. Each color selection indicia for a nib may span across only a portion of the perimeter of the cross-section of the tubular housing and may be located opposite in rotational position to that nib. Each color selection indicia for a nib may include a visual color that is approximately the same as the colored ink delivered to that nib.

The tubular housing may have a plurality of substantially flat longitudinal surfaces, each corresponding to one of the nibs.

There may be two and only two nibs. The tubular housing may have a substantially flattened oval cross-section with two and only two substantially flat longitudinal surfaces.

There may be three and only three nibs and the tubular housing may have three and only three substantially flat longitudinal surfaces that have a substantially triangular cross-section.

There may be four and only four nibs and the tubular housing may have four and only four substantially flat longitudinal surfaces that have a substantially rectangular cross-section.

Each fluid delivery system may include a capillary element configured to transfer fluid by capillary action.

Each nib may be a fountain pen nib. Each fountain pen nib may include two half nibs and each adjacent set of half nibs from neighboring fountain pen nibs may be configured to mix the inks that are delivered to their respective neighboring nibs.

There may be three and only tree nibs, reservoirs, and fluid delivery systems.

There may be two and only two nibs, reservoirs, and fluid delivery systems.

A multicolor writing and painting instrument may include a single, hard, wear-resistant nib at an end of the tubular housing. The nib may have a writing surface. A plurality of tubes may each lead to the writing surface of the nib. The tubes may form a plurality of openings on the writing surface. The openings may be arranged in clusters of one or more openings. Each cluster of openings may lie approximately along a circumference of a common circle. There may be a separate ink reservoir within the tubular housing for each cluster of openings. A fluid delivery system may be within the tubular housing and may be connected between each ink reservoir and the tubes which form the openings of one of the clusters of openings and configured to deliver fluid from the reservoir to which it is connected to the tubes to which it is connected.

The nib may be made of glass.

The nib may be made of ceramic.

Each cluster of openings may be spaced apart from the other clusters of openings.

Each tube may be configured to transfer fluid by capillary action.

Each fluid delivery system may include a capillary element configured to transfer fluid by capillary action.

The tubes which form the openings of each of the clusters of openings may lead to an ink distribution hub that is separate from all of the other ink distribution hubs.

There may be three and only three clusters of openings and reservoirs. One of the reservoirs may contain yellow ink, another cyan ink, and the other magenta ink.

There may be two and only two clusters of openings, ink reservoirs, and fluid delivery systems.

These, as well as other components, steps, features, objects, benefits, and advantages, will now become clear from a review of the following detailed description of illustrative embodiments, the accompanying drawings, and the claims

BRIEF DESCRIPTION OF DRAWINGS

The drawings disclose illustrative embodiments. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it is intended to refer to the same or like components or steps.

FIG. 2*a* illustrates a multicolor writing and painting instrument with multiple, bundled, hard, wear-resistant fountain pen nibs.

FIG. 2*b* illustrates a cross-section of the multicolor writing and painting instrument illustrated in FIG. 1*a* taken along the line 2*b*-2*b'*.

FIG. 5 has been omitted.

FIGS. 7*a*-7*c* are front, enlarged front, and rear views, respectively, of a multicolor writing and painting instrument with four, bundled, hard, wear-resistant nibs and a tubular housing have a square cross section and color selection indicia on corners of the housing.

FIG. 8*d* is a cut-away view of the portion of the multicolor writing and painting instrument illustrated in FIG. 8*c*.

FIG. 8*e* is a cut-away view of the writing end of the multicolor writing and painting instrument illustrated in FIG. 8*a* with the disk sector assembly removed.

FIG. 8*f* is a cut-away view of the outer conical section, disk sector assembly, and nib of the multicolor writing and painting instrument illustrated in FIG. 8*a*.

DETAILED DESCRIPTION OF ILLUSTRATIVE EMBODIMENTS

Illustrative embodiments are now discussed. Other embodiments may be used in addition or instead. Details that may be apparent or unnecessary may be omitted to save space or for a more effective presentation. Conversely, some embodiments may be practiced without all of the details that are disclosed.

Figure 1A:
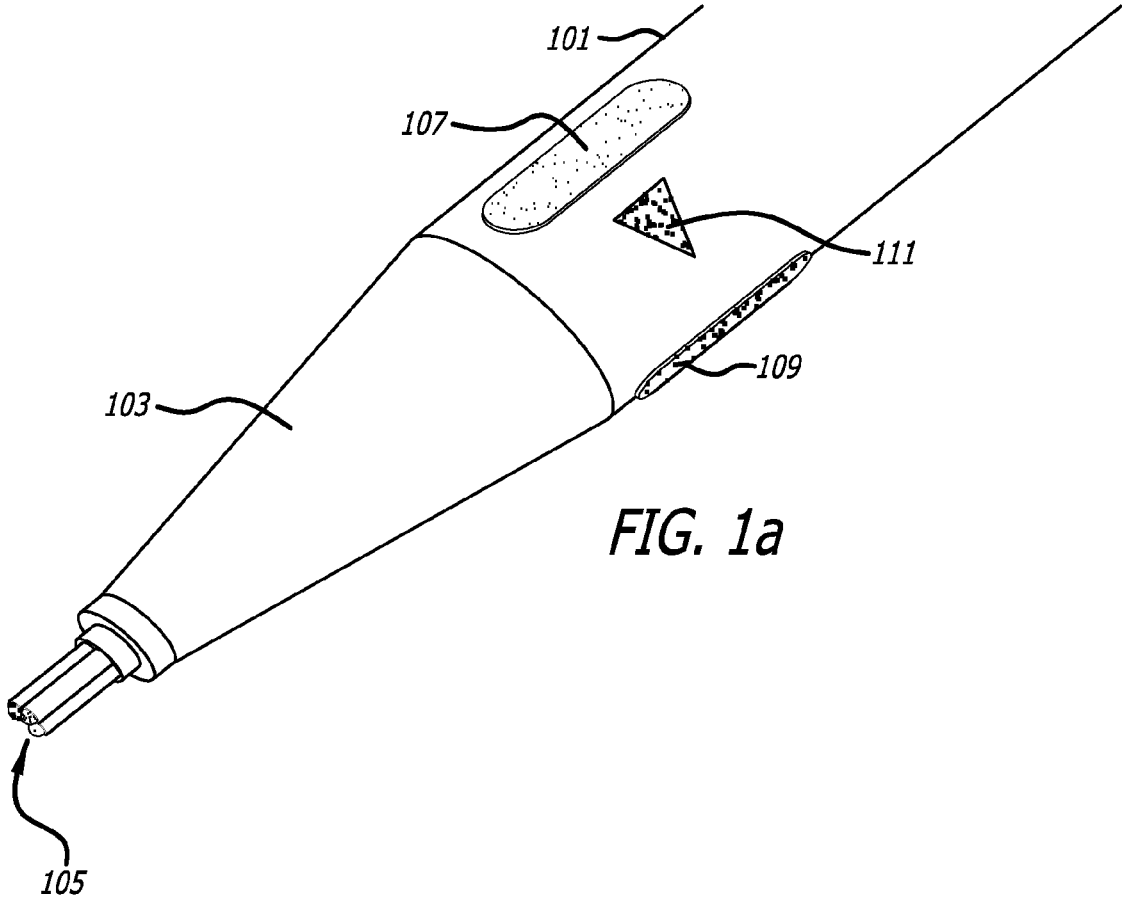
FIG. 1*a* illustrates a multicolor writing and painting instrument with multiple, bundled, hard, wear-resistant, needle-style roller ball nibs.
Figure 1B:
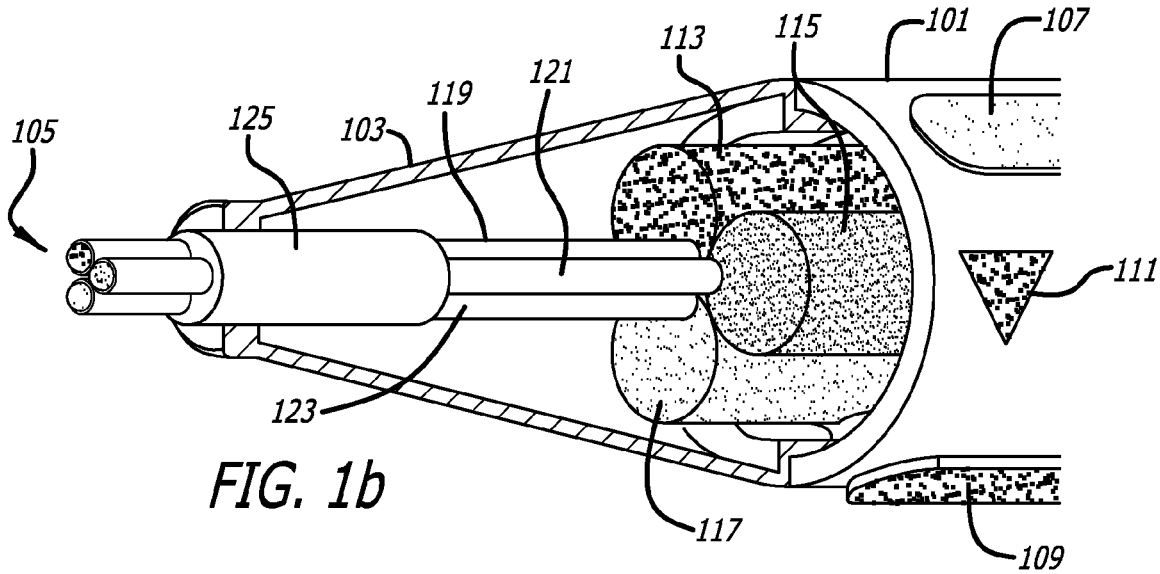
FIG. 1*b* illustrates a cut away view of the lower portion of the multicolor writing and painting instrument illustrated in FIG. 1*a*.

FIG. 1*a* illustrates a multicolor writing and painting instrument with multiple, bundled, hard, wear-resistant, needle-style roller ball nibs. FIG. 1*b* illustrates a cut away view of the lower portion of the multicolor writing and painting instrument illustrated in FIG. 1*a*.

This instrument may include a tubular housing 101 having a tapered section 103 that supports a plurality of nibs 105. A plurality of color selection indicia, such as color selection indicia 107 and 109, may appear on the tubular housing 101, along with a plurality of rotation indicators, such as a rotation indicator 111.

The nibs 105 may have tips which lie in substantially the same plane and on the circumference of a common circle. The nibs 105 may be made of a hard and wear-resistant material, such as metal (e.g., steel or titanium), glass, or ceramic.

The nibs 105 may be roller ball nibs. Any type of roller ball nib may be used. For example, the roller ball nibs may be needle-style roller ball nibs. Each may include a very small metallic roller ball installed at the end of a very thin metallic barrel.

There may be any number of nibs. Although three is illustrated, there may instead be two, four, five, six, or any other number.

The nibs 105 may be bundled together. Any technique may be used. The bundling may be tight so as to leave little space between them. To accomplish this, the tubes leading to the nibs may be braised together. Other bundling techniques may be used in addition or instead.

The collective diameter of the nibs 105 may be sufficiently small so as to cause their collective circumference to be approximately the same as a standard sized roller ball nib.

The instrument may include a plurality of ink reservoirs, one for each of the nibs. For example, the instrument may include an ink reservoir 113, 115, and 117.

The ink reservoirs may be of any type. For example, they may be refillable. They may include a piston to facilitate refilling and/or dispensing. They may be disposable and/or replaceable. They may include fluid absorbing material such as is commonly used in felt pen ink barrels.

Each ink reservoir may be filled with an ink. The color of the ink in each ink reservoir may be different from the color that is used in every other reservoir. For example, red, blue, and black ink may be used. Alternatively the primary colors yellow, cayenne, and magenta may be used.

A fluid delivery system may be used to deliver ink from each of the ink reservoirs to its respective nib. Any type of fluid delivery system may be used. For example, the fluid delivery system may include one or more capillary elements, such as tubes or fiber (e.g., felt). The fluid delivery system may in addition or instead rely upon gravity. A tube may again be used for this purpose. When a tube is used, it may be made of any material, such as plastic or metal. When relying upon gravity, the ink may be a gel ink that flows more gradually through tubes. This may not cause a bleeding phenomenon, the prevention of which may require capillary action inside the pen in the form of a fiber packed barrel or capillary parallel disks. Unlike what is illustrated in FIGS. 1*a*-1*b*, the fluid delivery system and ink reservoir for each nib may both be implement by a single tube such as is commonly found in a single-colored ink pen.

The fluid delivery system may include a pressure applicator configured to expel ink from an ink reservoir with pressure.

The fluid delivery system may include a fluid regulating mechanism, such as a closely packed set of discs, as is used in some liquid pens.

With respect to the instrument illustrated in FIGS. 1*a* and 1*b*, the fluid delivery system may include a tube connecting each ink reservoir to its corresponding nib, such as tubes 119, 121, and 123. The fluid delivery system may include a feed-through cylinder 125 that may help support the tubes and bundle them together.

The tubular housing 101 may be of any type, including any size, shape, or material, such as metal or plastic. The tubular housing may be configured to be sized and shaped to be comfortably held by fingers of a user.

The tapered section 103 of the tubular housing 101 may or may not be integral with the non-tapered section of the tubular housing 101. The tapered section 103 may be made of any material, such as rubber, plastic, or metal, and may be of any size or shape. The tapered section 103 may be sized and shaped to be comfortably held by fingers of a user.

The multicolor writing and painting instrument that is illustrated in FIGS. 1*a* and 1*b* may be used in any manner. For example, the tubular housing 101 may be held within the fingers of a user, much like an ordinary pen. However, the color with which the instrument writes may be dependent upon the rotational position of the instrument along its longitudinal axis while being held within the fingers. That color may be changed by rotating the instrument along its longitudinal axis.

The amount of needed rotation may depend upon the number of nibs. For example, if three nibs are used, a rotation of approximately 120° may change from one color to the next.

It may be possible to rotate the instrument to a position that causes two neighboring nibs to write simultaneously. This may result in two lines being written, each in a different color, or a single line that has a color resulting from the mixture of the two.

The instrument may be rotated without having to use the hand which is not writing. It may be rotated without lifting the instrument from the writing surface.

The color selection indicia, such as the color selection indicia 107 and 109, may be positioned on the tubular housing 101 so as to communicate to the user the color the instrument is positioned to write.

The color selection indicia may include color selection indicia for each nib. Each color selection indicia for a nib may span across only a portion of the perimeter of the cross-section of the tubular housing and may be located opposite in rotational position to that nib. Each color selection indicia for a nib may include a visual color that is approximately the same as the colored ink which is delivered to that nib. Thus, for example, a blue color selection indicia, such as the color selection indicia 107, may be positioned on the surface of the tubular housing 101 approximately 180° opposite of the rotational position of the roller ball nib which is connected to an ink reservoir containing blue ink.

The color selection indicia may be of any size, shape, and may be at any location. Although shown toward the lower portion of the instrument in FIG. 1*a*, for example, the color selection indicia may instead be on the tapered section 103 or on the middle or top of the longitudinal portion of the tubular housing 101.

Each color selection indicia may be only a single line or may occupy a greater portion of the circumference of the tubular housing 101. Each may span a shorter portion of the length of the tubular housing 101 than illustrated in FIG. 1*a* or a longer portion.

Rotational indicators, such as the rotation indicator 111, may be configured in a shape that indicates movement, such as an arrow. Each rotational indicator may bare the color of the next color selection indicia, thus communicating to the user the direction in which the user must rotate the instrument in order to change to that particular color.

The color selection indicia and the associated rotation indicators may be configured to be replaceable with indicators of different colors. Thus, any desired set of colors may be loaded into the various ink reservoirs and color and rotation indicators correctly corresponding to this set of colors may be attached to the tubular housing 101.

Figure 2C:
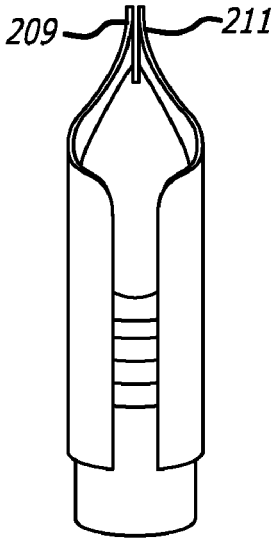
FIGS. 2*c*-2*e* are front, back, and side views, respectively, of one of the fountain pen nibs in the multicolor writing and painting instrument illustrated in FIG. 2*a*.
Figure 2D:
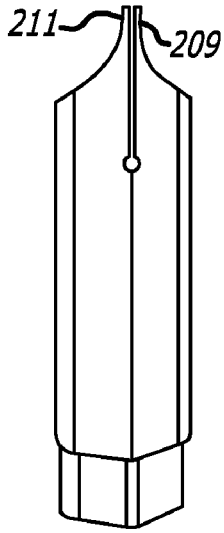
Figure 2E:
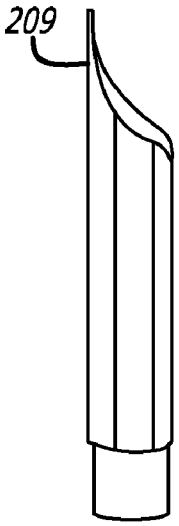

FIG. 2*a* illustrates a multicolor writing and painting instrument with multiple, bundled, hard, wear-resistant fountain pen nibs. FIG. 2*b* illustrates a cross-section of the multicolor writing and painting instrument illustrated in FIG. 1*a* taken along the line A-A'. FIGS. 2*c*-2*e* are front, back and side views, respectively, of one of the fountain pen nibs in the multicolor writing and painting instrument illustrated in FIG. 2*a*.

This instrument may include a tubular housing 201 having a tapered grip 203 which supports a plurality of nibs 205.

There may be an ink reservoir for each nib. The ink reservoirs may be of any type, including any of the types discussed elsewhere in this application.

The nibs may be fountain pen nibs. They may be made of a hard, wear-resistant material, such as metal (e.g., steel or titanium) or plastic. They may be placed back-to-back as close as possible so as to form a cylinder. Although three nibs are illustrated, a different number may be used, such as two, four, five, or six.

A fluid delivery system may be used to deliver ink to each nib from its corresponding ink reservoir. The types of fluid delivery systems that are commonly used in fountain pens may also be used, as well as any of the types of fluid delivery systems that are discussed elsewhere in this application.

The tubular housing 201 may be configured to house the ink reservoirs and the fluid delivery systems. The tubular housing may be of any type, including any of the types discussed elsewhere in this application.

Color selection indicia may be provided to signal to the user the color at which the instrument has been oriented to write. An example is a color selection indicia 207. Any other type of color selection indicia may be used, such as any of the types discussed elsewhere in this application.

The nibs 205 may be comprised of adjacent half-split nibs, such as half-split nibs 209 and 211 illustrated in FIGS. 2*c*-2*e*. When placed closely together, as illustrated in FIG. 2*a*, each adjacent set of half nibs from neighboring fountain pen nibs may mix the inks that are delivered to their respective neighboring nibs, thus allowing two colors to be written for every single color of ink that is stored in the ink reservoirs.

Figure 3A:
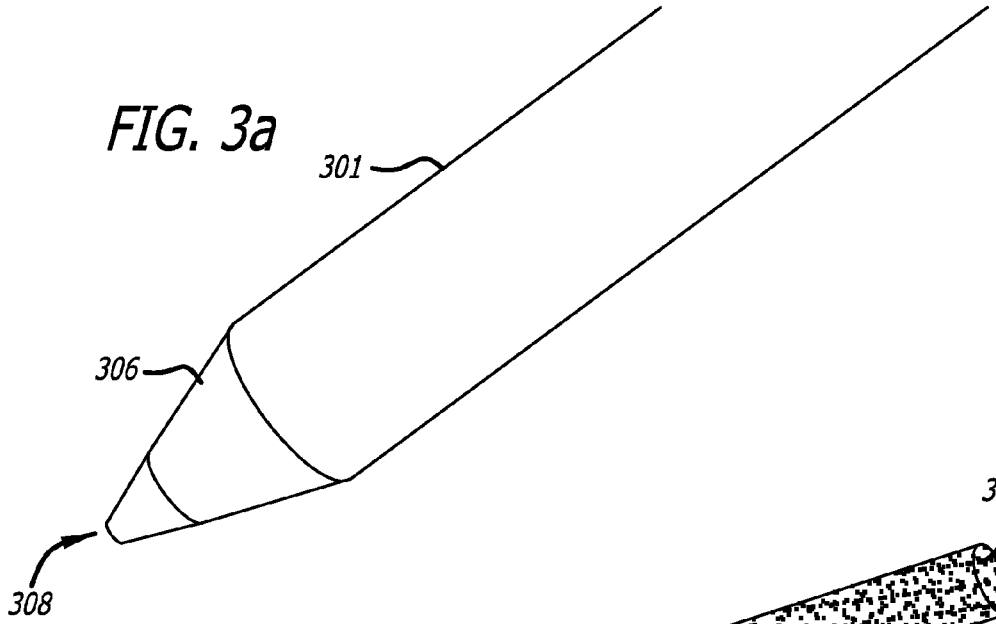
FIG. 3*a* illustrates a multicolor writing and painting instrument with a single, hard, wear-resistant nib having clusters of openings on the surface of the nib through which different colored ink is delivered.
Figure 3B:
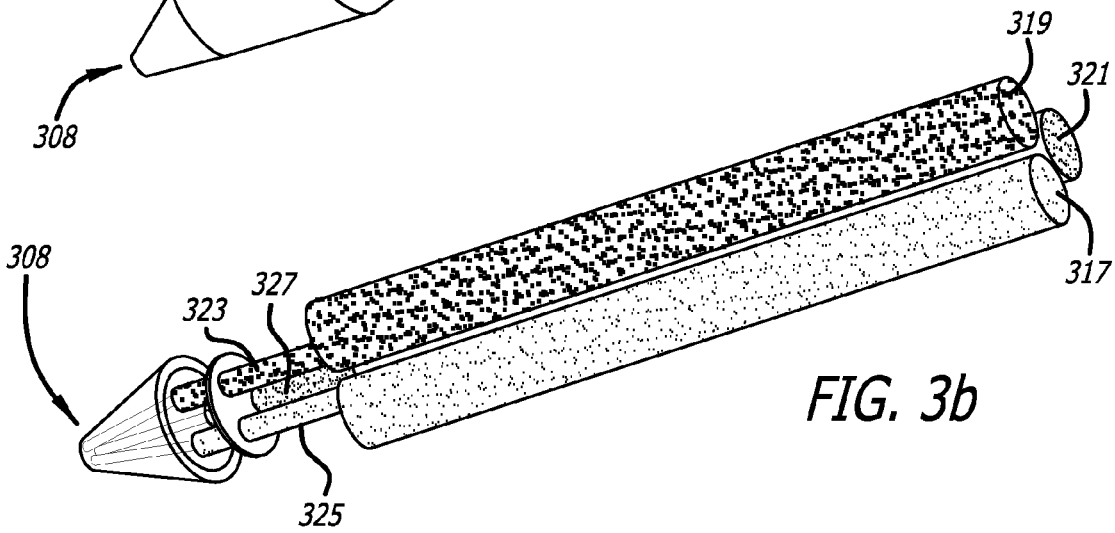
FIG. 3*b* illustrates the multicolor writing and painting instrument illustrated in FIG. 3*a* with the tubular housing removed.
Figure 3C:
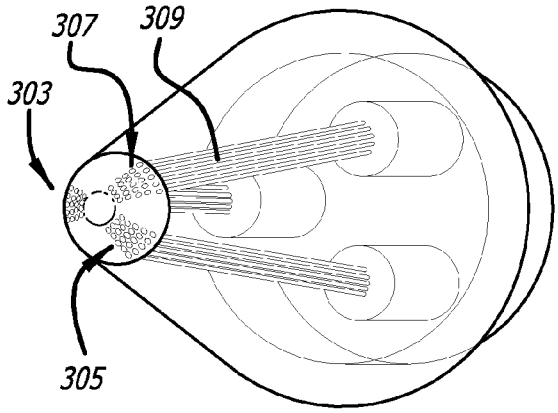
FIGS. 3*c* and 3*d* illustrate the front and rear, respectively, of the nib in the multicolor writing and painting instrument illustrated in FIG. 3*a*.
Figure 3D:
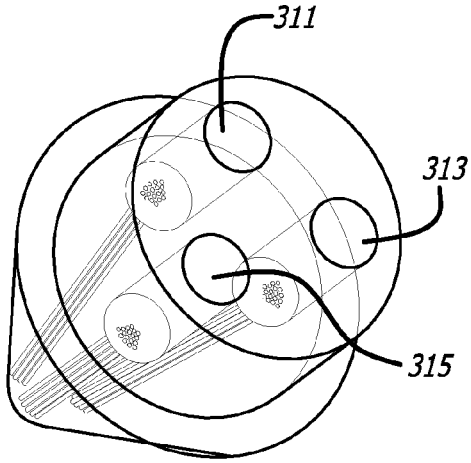

FIG. 3*a* illustrates a multicolor writing and painting instrument with a single, hard, wear-resistant nib having clusters of openings on the surface of the nib through which different colored ink is delivered. FIG. 3*b* illustrates the multicolor writing and painting instrument illustrated in FIG. 3*a* with the tubular housing removed. FIGS. 3*c* and 3*d* illustrate the front and rear, respectively, of the nib in the multicolor writing and painting instrument illustrated in FIG. 3*a*.

This instrument may include a tubular housing 301 which may have a tapered portion 306 that supports a single nib 308.

The nib 308 may be made of a hard, wear-resistant material, such as metal, ceramic, glass, or other solid and durable material.

There may be clusters of openings in the tip of the nib, such as clusters 303, 305, and 307. Although only three clusters, there may be a different number, such as two, four, five, or six.

There may be any number of openings in each cluster of openings. Although twenty are illustrated, there could be a different number, such as 2, 3, 4, 5-10, 10-15, 15-19, 21-25, 26-35, or 36-50.

Each of the clusters may be located approximately on a circumference of a common circle. Each cluster may or may not be separated from the others by a space which is greater than the space between each of its openings.

Each opening in a cluster may be an end of a tube, such as a tube 309. Each tube may be configured to deliver ink to its respective opening on the nib. Each tube may be of any type. For example, it may be sized to deliver ink using capillary action or gravity.

Any technique may be used to manufacture the tubes. When the nib 308 is glass, for example, the tubes may be produced by a laser-based Direct-Write Fabrication Process. This process may engrave the tubes directly into the glass material using a laser. It may selectively alter the characteristics of the desired regions using special, laser-sensitive glass. The laser-treated glass may then be chemically etched to remove the regions treated by the laser. Using this process, one or more microfluidic channels may be engraved by the laser inside the nib behind each cluster of openings.

For a metallic nib, for example, powdered metallurgy may be used to create porous sections in the metallic nib.

For a ceramic nib, for example, ceramic sinntering techniques may be used.

In lieu of tubes, felt or other types of capillary elements may be used.

The set of tubes or other ink-delivering apparatus which form the openings of each cluster may all collectively be fed from a single ink distribution hub, such as an ink distribution hub 311 for the tubes forming the opening clusters 303, an ink distribution hub 313 for the tubes forming the opening clusters 305, and an ink distribution hub 315 for the tubes forming the opening clusters 307. Thus, all of the tubes or other feeding mechanisms that form the openings of a single cluster may all be fed with the same color ink. The shape, size, and/or depth of each ink distribution hub may be different than is illustrated.

There may be an ink reservoir for each cluster of openings, such as ink reservoirs 317, 319, and 321. Any type of ink reservoir may be used, such as any of types of ink reservoirs that have been discussed elsewhere in this application.

A different color ink may be placed in each ink reservoir. For example, when three clusters of openings are used, the three ink reservoirs may be filled with ink having one of the primary colors.

A fluid delivery system may be employed to deliver ink from each reservoir to its respective ink distribution hub. For example, tubes 323, 325, and 327 may be used for this purpose. Any other type of fluid delivery system may be used, such as any of the types discussed elsewhere in this application.

The tubular housing 301 may be may be configured to house the ink reservoirs and the fluid delivery systems. The tubular housing 301 may be of any type, such as any of the types discussed elsewhere in this application.

When having three clusters of openings and when containing inks having the three primary colors, the instrument that is illustrated in FIGS. 3*a*-3*d* may be capable of generating any color by rotating the instrument to the position that causes the inks to be combined in the amount that is necessary for that color. For example, when one of the primary colors is desired, the instrument may be rotated to a position at which only the openings from the cluster for that color come in contact with the writing surface. When a color is desired that lies midway between two primary colors, for example, the instrument may be rotated to the position which causes an equal number of the openings in the two neighboring clusters that make up this color to come in contact with the writing surface. When the color requires a larger amount of one primary color than another, the instrument may be rotated to the position that causes an unequal number of the openings from the two neighboring clusters that make up this color to come in contact with the writing surface.

Color selection indicia may be provided to signal to the user the color at which the instrument has been oriented to write. The color selection indicia may be of any type, such as any of the types discussed elsewhere in this application.

The tubular housing of the writing instrument may have a cross-section that may help communicate to the user the color which has been selected and that may help maintain the rotational position that has been selected for that color. These are referred to herein as "form factors." Examples of these are now discussed.

Figure 4A:
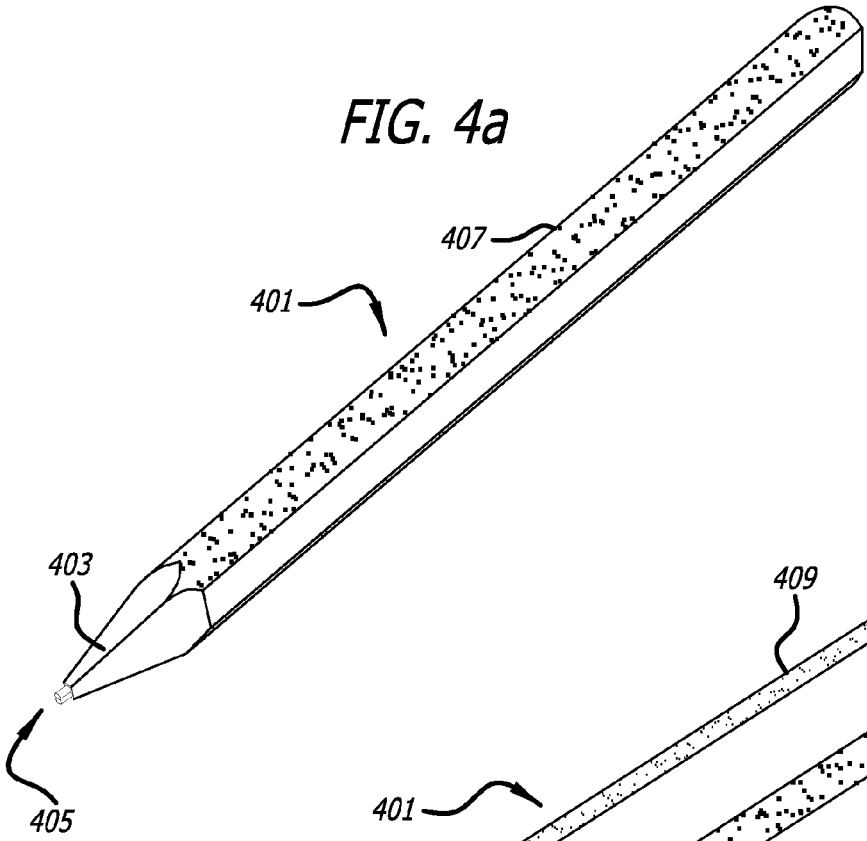
FIGS. 4*a*, 4*b*, and 5, front, rear, and enlarged front views, respectively, of a multicolor writing and painting instrument with two, bundled, hard, wear-resistant nibs and a tubular housing have a flattened oval cross section and color selection indicia on two opposing rounded sections.
Figure 4B:
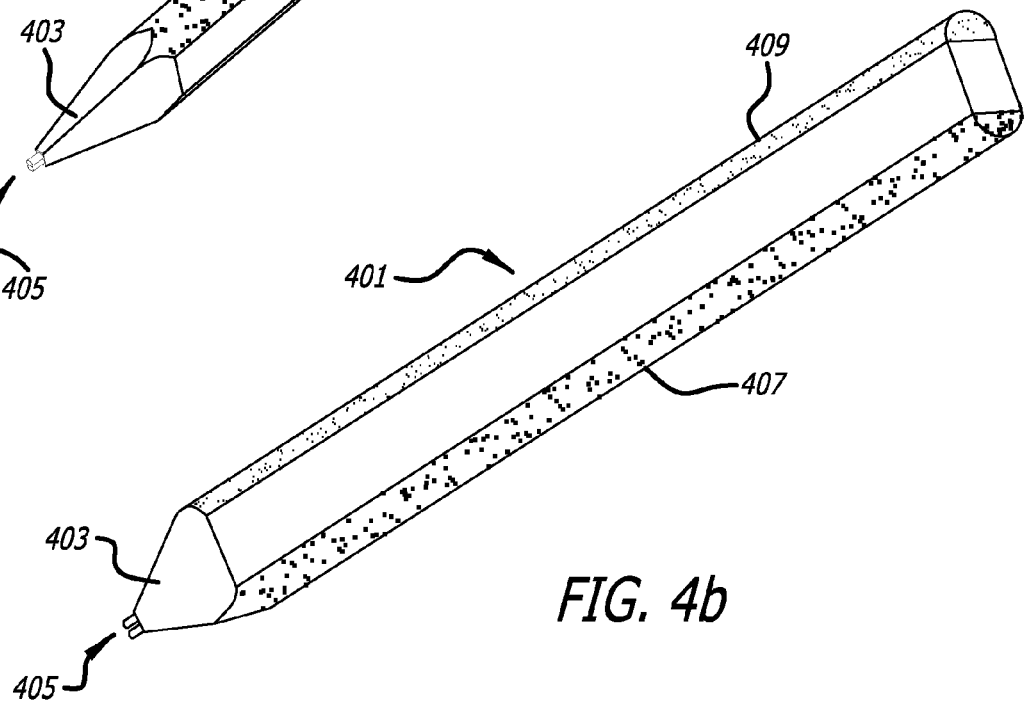
Figure 5:
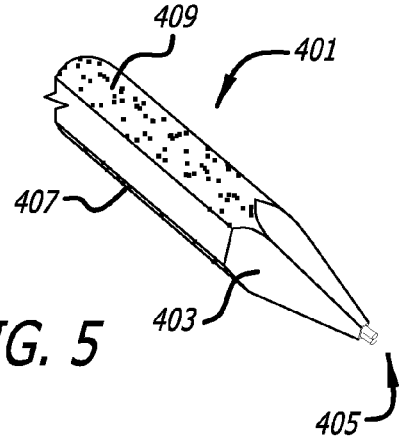

FIGS. 4*a*, 4*b*, and 5 are front, rear, enlarged front, views, respectively, of a multicolor writing and painting instrument with two, bundled, hard, wear-resistant nibs and a tubular housing have a flattened oval cross section and color selection indicia on two opposing rounded sections.

This instrument may include a tubular housing 401 having a tapered portion 403 that supports two nibs 405.

The two nibs 405 may be of any type, including any of the types discussed elsewhere in this application.

There may be an ink reservoir for each nib. The ink reservoirs may be of any type, including any of the types discussed elsewhere in this application.

Each ink reservoir may contain a different colored ink. Any colors may be used, including any of the colors and color sets discussed elsewhere in this application.

A fluid delivery system may be used to deliver ink to each nib from its corresponding ink reservoir. The fluid delivery systems may be of any type, including any of the types of fluid delivery systems that are discussed elsewhere in this application.

The tubular housing 401 may be may be configured to house the ink reservoirs and the fluid delivery systems. The tubular housing may be of any type, such as any of the types discussed elsewhere in this application.

The tubular housing 401 may have a substantially, flattened, oval-cross-section. It may include a color selection indicia 407 for one of the nibs and a color selection indicia 409 for the other nib. Each color selection indicia may be located on the tubular housing 401 at a location which is approximately 180 degrees opposite of the position of the nib whose writing color it indicates. Each color selection indicia may be in the shape of a semi-cylinder and bear the color at which its opposing nib may write. In a different embodiment, the two nibs may be rotated approximately 90° and each of their respective color selection indicia may instead be on the flat faces of the tubular housing 401.

The color selection indicia may be of any other type, such as any of the types discussed elsewhere in this application.

Figure 6A:
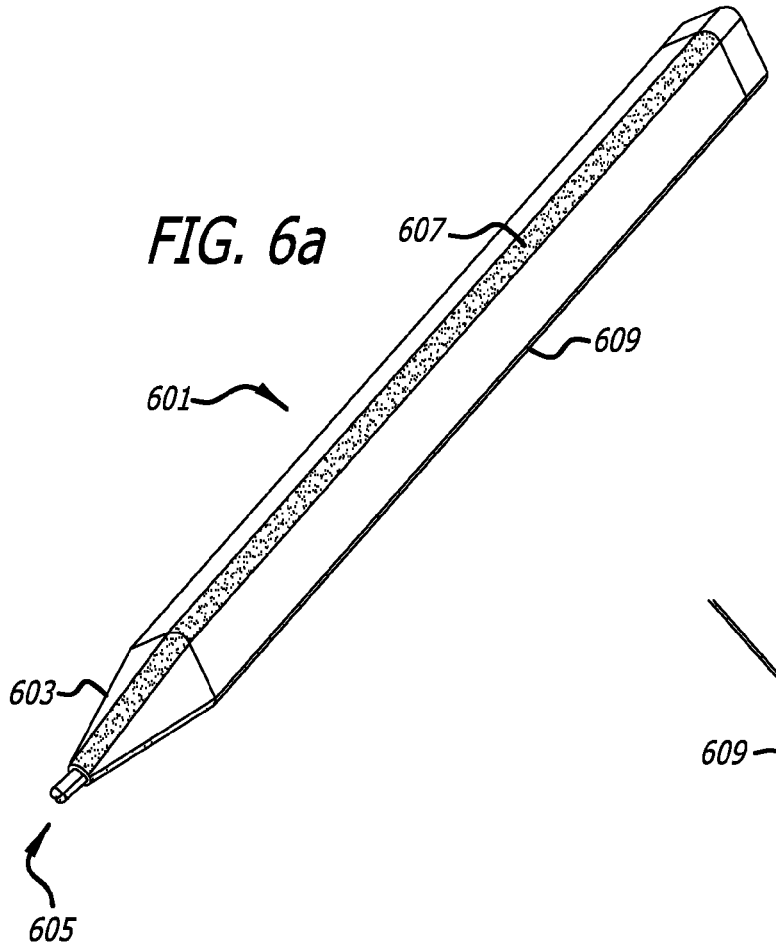
FIGS. 6*a*-6*c* are front, enlarged front, and rear views, respectively, of a multicolor writing and painting instrument with three, bundled, hard, wear-resistant nibs and a tubular housing have a triangular cross section with color selection indicia on corners of the housing.
Figure 6B:
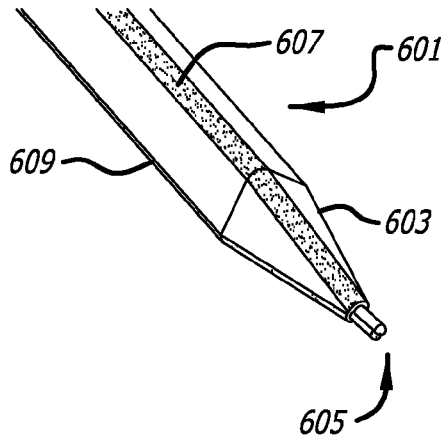
Figure 6C:
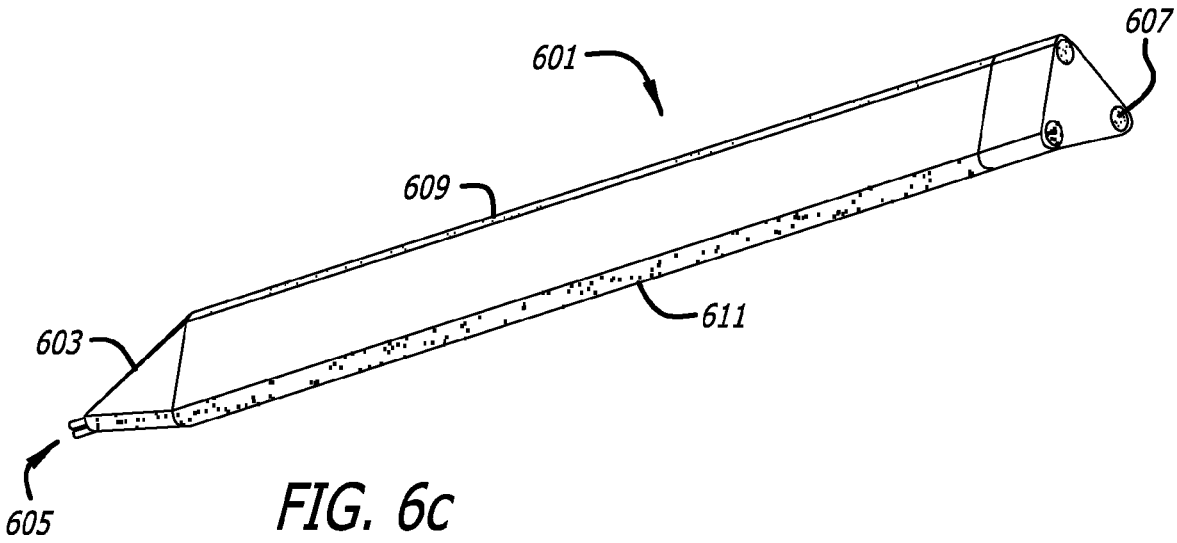

FIGS. 6*a*-6*c* are front, enlarged front, and rear views, respectively, of a multicolor writing and painting instrument with three, bundled, hard, wear-resistant nibs and a tubular housing have a triangular cross section with color selection indicia on corners of the housing.

This instrument may have a tubular housing 601 having a tapered portion 603 supporting three nibs 605.

The three nibs 605 may be of any type, including any of the types discussed elsewhere in this application.

There may be an ink reservoir for each nib. The ink reservoirs may be of any type, including any of the types discussed elsewhere in this application.

Each ink reservoir may contain a different colored ink. Any colors may be used, including any of the colors and color sets discussed elsewhere in this application.

A fluid delivery system may be used to deliver ink to each nib from its corresponding ink reservoir. The fluid delivery systems may be of any type, including any of the types of fluid delivery systems that are discussed elsewhere in this application.

The tubular housing 601 may be may be configured to house the ink reservoirs and the fluid delivery systems. The tubular housing may be of any type, such as any of the types discussed elsewhere in this application.

The tubular housing 601 may have a substantially triangular cross-section. The color selection indicia for each respective nib may be positioned on the opposing corner of the triangular cross-section of the tubular housing 601, such as is illustrated in connection with color selection indicia 607, 609, and 611. Each color selection indicia may be rod-like and may protrude into a top portion 613 of the tubular housing 601 to indicate the selected color from this top portion.

The three nibs 605 may instead be rotated approximately 60° from the position illustrated in FIGS. 6*a*-6*c* with respect to the tubular housing 601. In this case, the corresponding color selection indicia may instead appear on the flat portions of the surfaces of the tubular housing 601.

The color selection indicia may be of any other type, such as any of the types discussed elsewhere in this application.

FIGS. 7*a*-7*c* are front, enlarged front, and rear views, respectively, of a multicolor writing and painting instrument with four, bundled, hard, wear-resistant nibs and a tubular housing have a square cross section and color selection indicia on corners of the housing.

This instrument may include a tubular housing 701 which may include a tapered portion 703 supporting four bundled nibs 705.

The four nibs 705 may be of any type, including any of the types discussed elsewhere in this application.

There may be an ink reservoir for each nib. The ink reservoirs may be of any type, including any of the types discussed elsewhere in this application.

Each ink reservoir may contain a different colored ink. Any colors may be used, including any of the colors and color sets discussed elsewhere in this application.

A fluid delivery system may be used to deliver ink to each nib from its corresponding ink reservoir. The fluid delivery systems may be of any type, including any of the types of fluid delivery systems that are discussed elsewhere in this application.

The tubular housing may be configured to house the ink reservoirs and the fluid delivery systems. The tubular housing may be of any type, such as any of the types discussed elsewhere in this application.

The tubular housing 701 may have a rectangular cross-section. A color selection indicia may be provided on each corner of the tubular housing 701 indicating the color of the nib which is at a rotational position that is approximately 180° away, such as color selection indicia 709, 711, 713, and 715. Each color selection indicia may be of the same type as illustrated in FIGS. 6*a*-6*c* and as discussed above. In an alternate embodiment, the bundled nibs may be rotated approximately 45° with respect to the tubular housing 701, in which case the color selection indicia may appear on the flat faces of the tubular housing 701, rather than on the corners.

The color selection indicia may be of any other type, such as any of the types discussed elsewhere in this application.

Figure 8A:
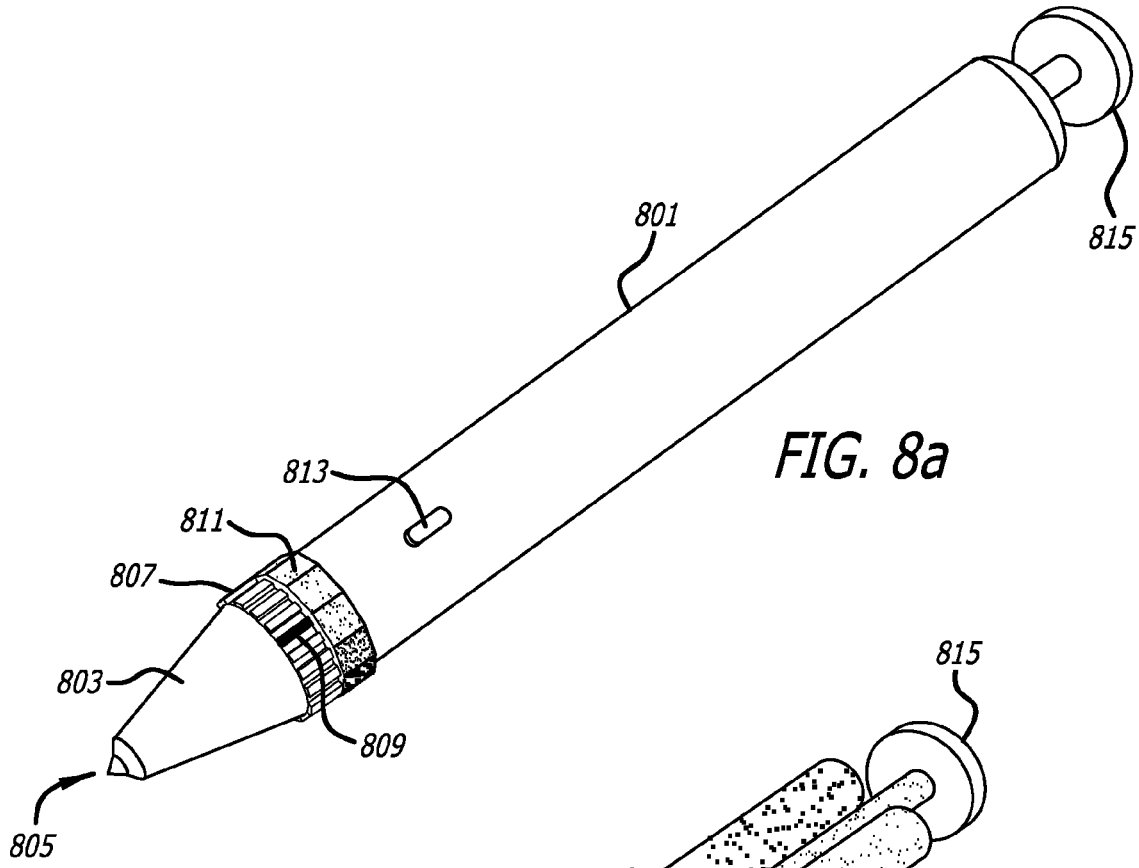
FIG. 8*a* illustrates a multicolor writing and painting instrument with a single nib fed with user-selected colored ink(s) that uses an ink-receiving surface that is a flat disk sector.
Figure 8B:
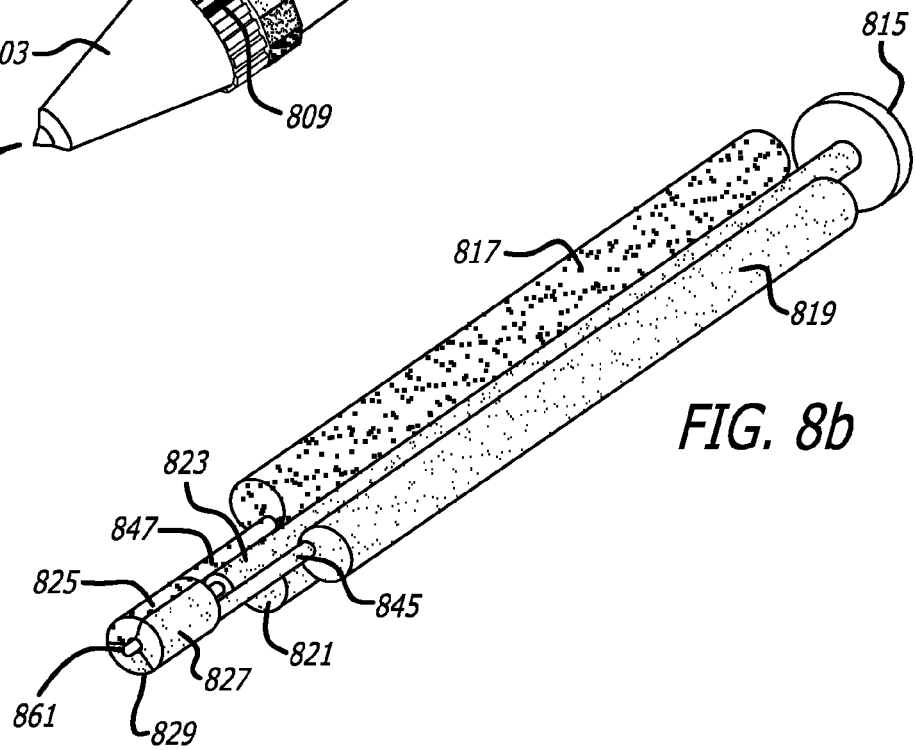
FIG. 8*b* illustrates internal reservoirs and cylinder sectors in the multicolor writing and painting instrument illustrated in FIG. 8*a*.
Figure 8C:
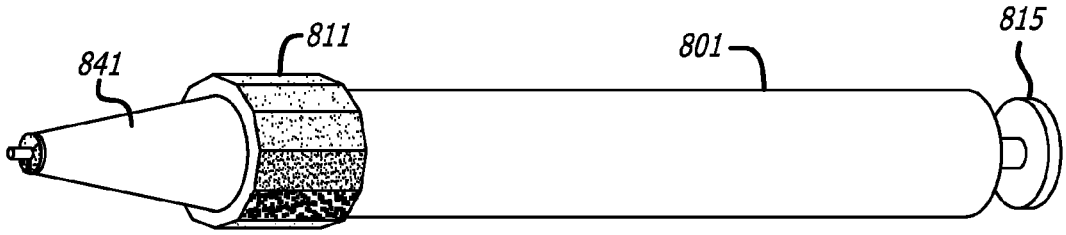
FIG. 8*c* illustrates the multicolor writing and painting instrument illustrated in FIG. 8*a* with the conical outer section of the tubular housing removed.
Figure 8G:
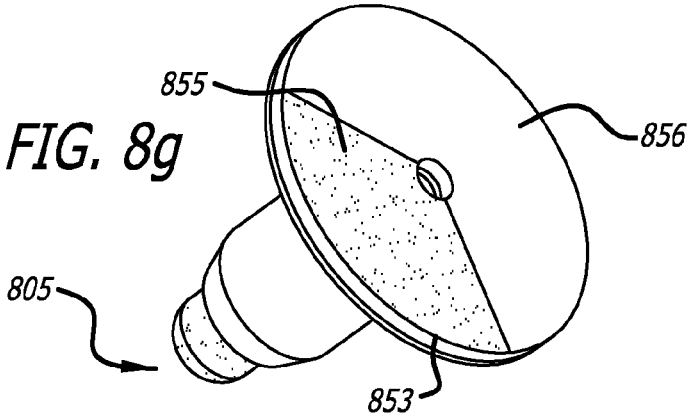
FIG. 8*g* illustrates the disk sector assembly and the nib of the multicolor writing and painting instrument illustrated in FIG. 8*a*.
Figure 8H:
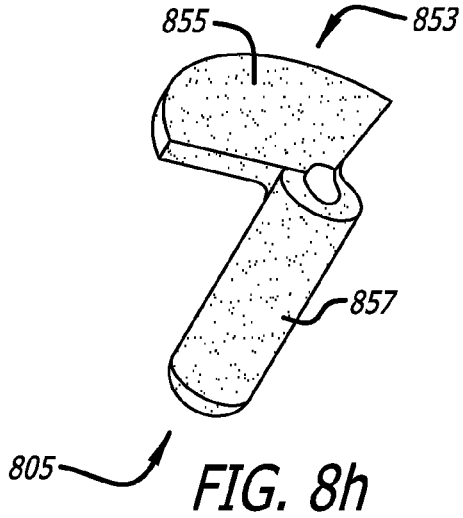
FIGS. 8*h* and 8*i* illustrate front and rear views, respectively, of the flat disk sector and nib of the multicolor writing and painting instrument illustrated in FIG. 8*a*.
Figure 8I:
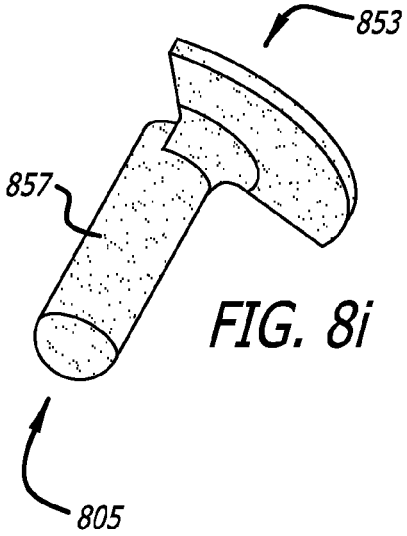
Figure 8J:
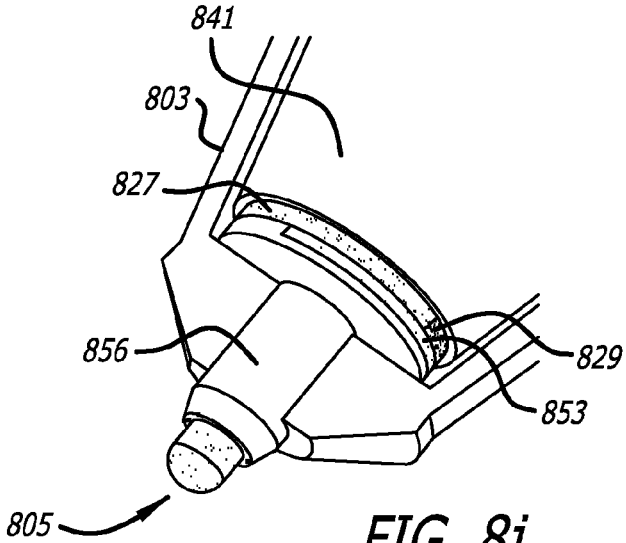
FIG. 8*j* illustrates the flat disk sector in the multicolor writing and painting instrument illustrated in FIG. 8*a* positioned to absorb approximately equally rates of ink flow from surfaces of two of the three cylinder sectors.

FIG. 8*a* illustrates a multicolor writing and painting instrument with a single nib fed with user-selected colored ink(s) that uses an ink-receiving surface that is a flat disk sector. FIG. 8*b* illustrates internal reservoirs and cylinder sectors in the multicolor writing and painting instrument illustrated in FIG. 8*a*. FIG. 8*c* illustrates the multicolor writing and painting instrument illustrated in FIG. 8*a* with the conical outer section of the tubular housing removed. FIG. 8*d* is a cut-away view of the portion of the multicolor writing and painting instrument illustrated in FIG. 8*c*. FIG. 8*e* is a cut-away view of the writing end of the multicolor writing and painting instrument illustrated in FIG. 8*a* with the disk sector assembly removed. FIG. 8*f* is a cut-away view of the outer conical section, disk sector assembly, and nib of the multicolor writing and painting instrument illustrated in FIG. 8*a*. FIG. 8*g* illustrates the disk sector assembly and the nib of the multicolor writing and painting instrument illustrated in FIG. 8*a*. FIGS. 8*h* and 8*i* illustrate front and rear views, respectively, of the flat disk sector and nib of the multicolor writing and painting instrument illustrated in FIG. 8*a*. FIG. 8*j* illustrates the flat disk sector in the multicolor writing and painting instrument illustrated in FIG. 8*a* positioned to absorb approximately equally rates of ink flow from surfaces of two of the three cylinder sectors.

This instrument may include a tubular housing 801 having a tapered outer section 803 supporting a single nib 805, a color selector control 807 having a color selector indicator 809, color indicia 811, a disengagement control 813, and a dilution control 815.

The instrument may include a plurality of fluid reservoirs, such as ink reservoirs 817, 819, 821, and clear fluid reservoir 823. A different number of ink reservoirs may be used instead, such as two, three, five, six, or more.

A different number of ink reservoirs may be used instead, such as two, three, five, six, or more. The ink reservoirs may be of any type, including any of the types discussed elsewhere in this application.

Each ink reservoir may contain a different colored ink. Any colors may be used, including any of the colors and color sets discussed elsewhere in this application. When three ink reservoirs are use, for example, each may be filled with one of the primary colors.

The clear fluid reservoir 823 may hold a clear fluid of a type that readily dilutes the other inks when mixed with them.

The nib 805 may be of any type. For example, the nib 805 may be a roller ball nib, a fountain pen nib, or a capillary element, such as felt. The nib 805 may be any of the types discussed elsewhere in this application.

A fluid delivery system may be used to controllably deliver ink from one or more of the reservoirs to an ink-receiving surface 855. The fluid delivery systems may be of any type. For example, each fluid delivery system may include a cylindrical sector associated with each ink reservoir, such as cylindrical sectors 825, 827, and 829. All of the cylindrical sectors may be configured such that they form an ink-delivery cylinder when fitted together, such as an ink-delivery cylinder 832. Each cylindrical sector may have a sector-like end surface, such as sector-like end surfaces 833, 835, and 837.

Each cylindrical sector may be of any size, configuration, or material. Each cylindrical sector and its associate sector-like end surface may include a capillary element such as felt. Each cylindrical sector may in addition or instead be configured to allow ink to flow to its respective sector-like end surface by gravity. Each cylindrical sector may include an ink flow regulator. Each cylindrical sector may be hollow or may contain ink absorbing material.

A tapered inner section 841 may be configured to retain the cylindrical sectors 825, 827, and 829 which make up the ink delivery cylinder 832.

The color indicia 811 may include a series of flat surfaces arranged in a circle, each surface bearing a different color. The colors may be sequenced in the order of the spectrum of colors that result from pairs of the primary colors being mixed at different concentrations. The color indicia may instead be completely cylindrical and may instead be a continuous spectrum of these colors.

Each cylindrical sector may be in fluid communication with one of the ink reservoirs using any type of fluid delivery system. For example, the cylindrical sectors may each be connected to their respective ink reservoirs by capillary or gravitational elements, such as capillary or gravitational elements 845, 847, and a third one which cannot be seen. These may be tubes or felt. Any other type of fluid delivery systems may be used in addition or instead, including any of the types discussed elsewhere in this application.

The instrument may include a disc sector assembly 851 affixed at a lower end of the tapered outer section 803, as illustrated in FIG. 8*f*. The disc sector assembly 851 may include a flat disc sector 853 fixably mounted within a disc sector housing 856. The flat disc sector 853 may have an ink-receiving surface 855 which is configured to receive and deliver ink to the nib 805 through an intervening element 857. The flat disc sector 853 and the intervening element 857 may be of any type. For example, they may be capillary elements, such as felt. The disc sector housing 856, on the other hand, may be made of material that does not absorb or otherwise conduct fluid, such as metal or plastic.

The disc sector housing 856 in combination with house the flat disc sector 853 may create a circular surface. However, only the flat disc sector 853 may absorb and conduct fluid.

The flat disc sector 853 and the intervening element 857 may have a clear fluid lumen 859 which may be configured to receive clear fluid and to deliver it, along with all other fluid that is received by the ink-receiving surface 855 of the flat disc sector 853 through the intervening element 857 to the nib 805. Inks which are received on the flat ink-receiving surface 855 and clear fluid which is received in the clear fluid lumen 859 may be mixed by the capillary action of the intervening element 857 and/or by the nib 805.

The entire volume of the flat disc sector 853 and the intervening element 857 may be small so as only to store a minimum amount of fluid.

The tapered outer section 803 with the attached disc sector assembly 851 may be rotatably attached to the tapered inner section 841 such that the tapered outer section 803 and disc sector assembly 851 may rotate with respect to the tapered inner section 841. While so attached, the circular surface of the disc sector assembly 851 may engage and be aligned with the sector-like end surfaces 831, 833, and 835, as illustrated in FIG. 8*j*. At the same time, the clear fluid lumen 859 may be positioned directly in front of the longitudinal extension position of a fluid delivery pen 861 which, in turn, may be fluidically coupled to the clear fluid reservoir 823. Any type of fluid delivery system may be used to accomplish this coupling, such as any of the types discussed elsewhere in this application.

While so configured, rotation of the color selector control 807 may cause the flat disc sector 853 to rotate and, in turn, its ink-receiving surface 855 to shift with respect to the sector-like end surfaces 831, 833, and 835. In turn, this may cause the ink-receiving surface 855 to engage one or two of these sector-like end surfaces. When the tapered outer section 803 is at one rotational position with respect to the tubular housing 801, for example, the ink-receiving surface 855 of the flat disc sector 853 may be entirely aligned with just one of the sector-like end surfaces. When rotated approximately 60° from this position, or example, the ink-receiving surface 855 may instead engage half of two neighboring sector-like end surfaces, as illustrated in FIG. 8*j*. Thus, the ink-receiving surface 855 of the flat disc sector 853 may be rotated by the color selector control 807 so as to cause the flat disc sector 853 to engage only a single sector-like end surface or two neighboring sector-like end surfaces at any desired neighboring surface area ratio. The ratio of ink flow rates from neighboring sector-like end surfaces may be proportional to the ratio of their contact area with the ink-receiving surface 855. In turn, this may allow the color selector control 807 to select any desired color.

The dilution control 815 may be threadingly engaged to the top of the tubular housing 801. Rotation of the dilution control may therefore affect the degree to which the clear fluid delivery pen 861 is inserted into the clear fluid lumen 859. Rotation of the dilution control 815 may therefore affect the degree to which the inks are diluted and, in turn, the intensity of the inks when written.

When not in use, the disengagement control 813 may be actuated. Appropriate linkages may, in turn, cause the sector-like end surfaces 831, 833, and 835 to completely disengage from the circular surface of the disc sector assembly 851, thus ensuring that ink does not continue to flow onto the ink-receiving surface 855. The disengagement control 813 may be configured to be automatically actuated by placement of a cap (not shown) on the instrument.

After the color selector control 807 is rotated to select a different color, the small amount of the previous color that is stored on the ink-receiving surface 855, in the intervening element 857, and in the nib 805, may be removed by writing on a scratch piece of paper. Once the color changes to the new desired color, the instrument may again be used on the desired writing surface.

The nib 805 may instead be made of numerous independent capillary channels that separately connect numerous points on the ink-receiving surface 855 directly to numerous points on the surface of the tip of the nib 805, somewhat like is illustrated in FIG. 3*c*. In this configuration, there may be no need to separate the sector-like end surfaces 831, 833, and 835 from the ink-receiving surface 855 during non-use because the capillary elements may not cross one another.

The tubular housing 801 may be may be configured to house the ink reservoirs and the fluid delivery systems. The tubular housing may be of any type, such as any of the types discussed elsewhere in this application.

Figure 9A:
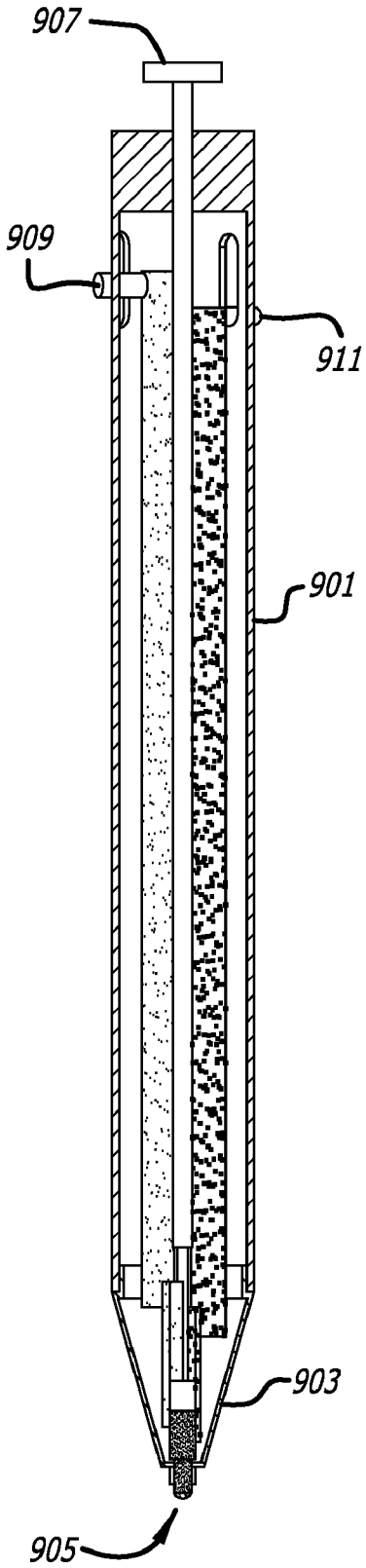
FIGS. 9*a* and 9*b* are cut-away views of the front and rear, respectively, of a multicolor writing and painting instrument with a single nib fed with user-selected colored ink(s) that uses a fluid delivery system having reciprocating capillary elements.
Figure 9B:
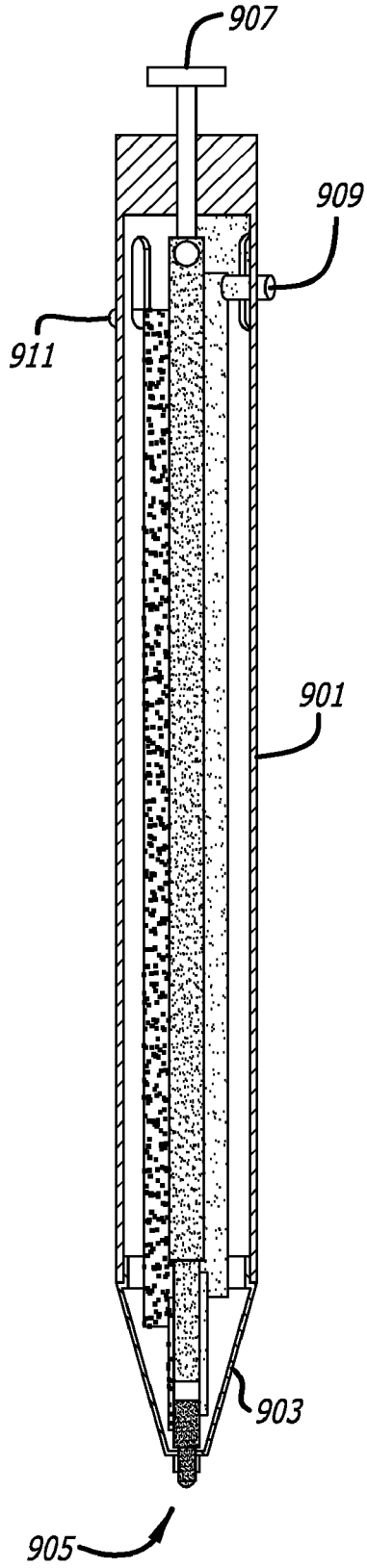
Figure 9C:
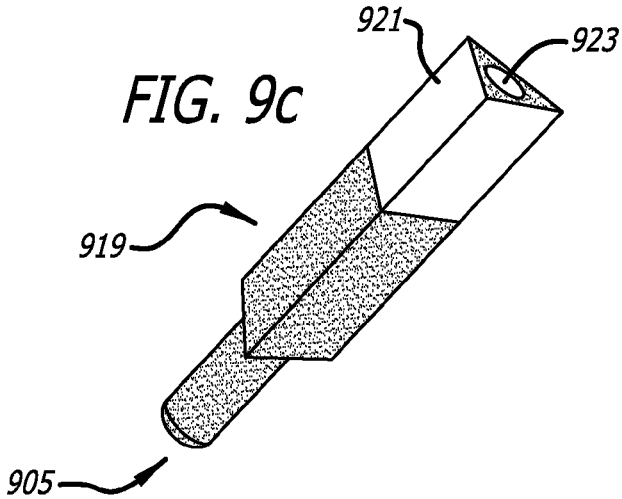
FIG. 9*c* illustrates a prismatic capillary element in the color writing and painting instrument illustrated in FIGS. 9*a* and 9*b*.
Figure 9D:
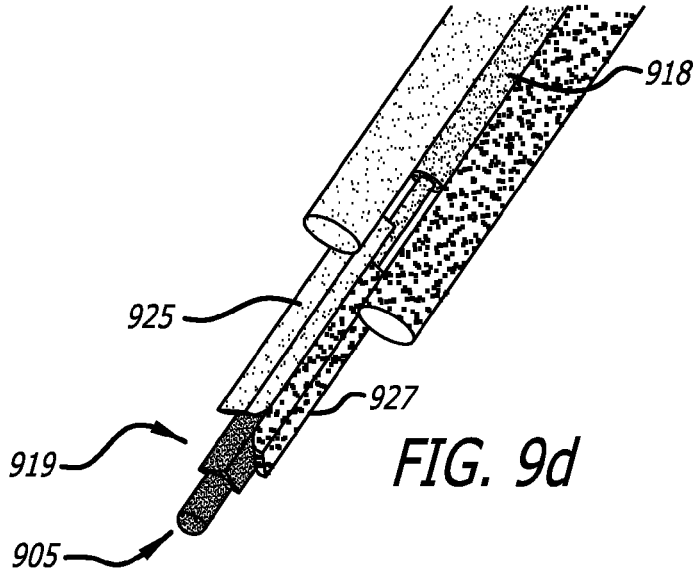
FIGS. 9*d*-9*f* illustrate different perspectives of reciprocating capillary elements in the color writing and painting instrument illustrated in FIGS. 9*a* and 9*b*.
Figure 9E:
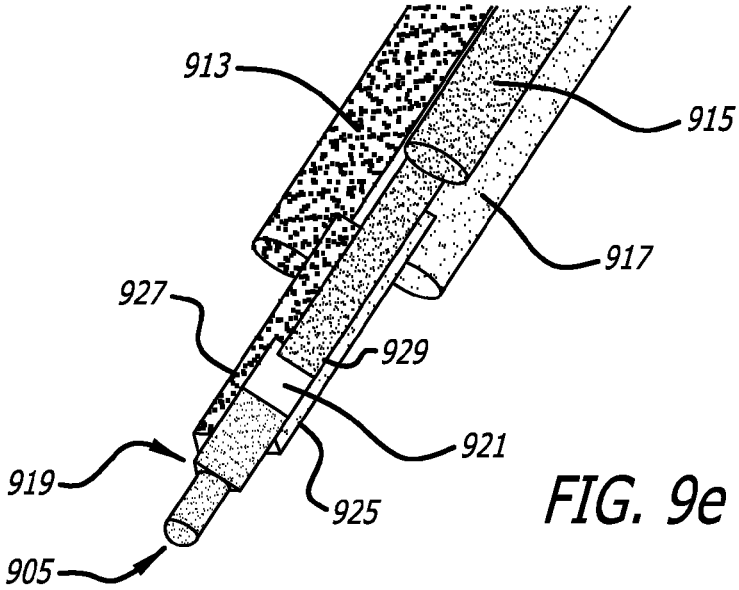
Figure 9F:
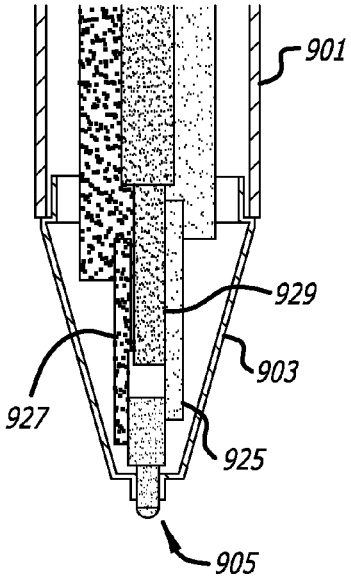
Figure 9G:
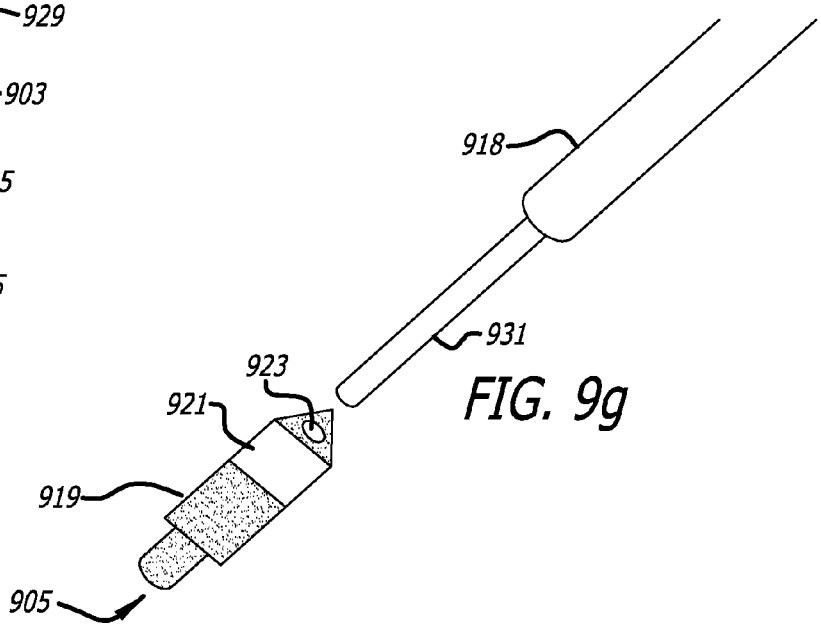
FIG. 9*g* illustrate a reciprocating capillary element positioned to introduce clear fluid into the prismatic capillary element in the color writing and painting instrument illustrated in FIGS. 9*a* and 9*b*.
Figure 9H:
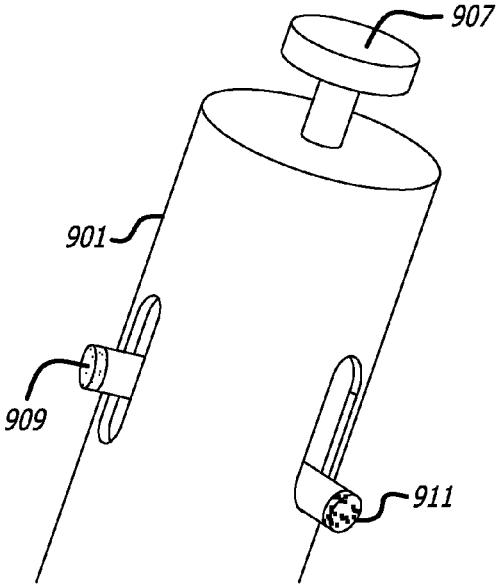
FIG. 9*h* illustrate color selection control sliders and a dilution control protruding from the tubular housing of the color writing and painting instrument illustrated in FIGS. 9*a* and 9*b*.

FIGS. 9*a* and 9*b* are cut-away views of the front and rear, respectively, of a multicolor writing and painting instrument with a single nib fed with user-selected colored ink(s) that uses a fluid delivery system having reciprocating capillary elements. FIG. 9*c* illustrates a prismatic capillary element in the color writing and painting instrument illustrated in FIGS. 9*a* and 9*b*. FIGS. 9*d*-9*f* illustrate different perspectives of reciprocating capillary elements in the color writing and painting instrument illustrated in FIGS. 9*a* and 9*b*. FIG. 9*g* illustrate a reciprocating capillary element positioned to introduce clear fluid into the prismatic capillary element in the color writing and painting instrument illustrated in FIGS. 9*a* and 9*b*. FIG. 9*h* illustrate color selection control sliders and a dilution control protruding from the tubular housing of the color writing and painting instrument illustrated in FIGS. 9*a* and 9*b*.

This instrument may include a tubular housing 901 having a tapered portion 903 supporting a single nib 905, a dilution control 907, and a color selector slider for each color that is used, such as color selection control sliders 909 and 911.

The nib 405 may be of any type, including any of the types discussed elsewhere in this application.

The instrument may include a plurality of fluid reservoirs, such as ink reservoirs 913, 915, 917, and 918 and clear fluid reservoir 918 which may be centrally located.

A different number of ink reservoirs may be used instead, such as two, three, five, six, or more. The ink reservoirs may be of any type, including any of the types discussed elsewhere in this application.

Each ink reservoir may contain a different colored ink. Any colors may be used, including any of the colors and color sets discussed elsewhere in this application. When three ink reservoirs are use, for example, each may be filled with one of the primary colors.

A fluid delivery system may be used to controllably deliver ink from one or more of the reservoirs to ink-receiving surfaces on a stationary capillary element 919. The fluid delivery systems may be of any type, including any of the types of fluid delivery systems that are discussed elsewhere in this application.

The stationary capillary element 919 may be fluidically connected to the nib 905. The stationary capillary element 919 may be made of any material, such as felt. The stationary capillary element 919 may be configured to have a plurality of flat external surfaces, one for each color of ink. When only three ink colors are used, the stationary capillary element 919 may have three surfaces and be triangular in cross section.

The stationary capillary element 919 may have an insulating cover 921 which may completely surround an upper portion of the stationary capillary element 919 and may be made of a material that does not absorb ink.

The stationary capillary element 919 may have a clear fluid lumen 923. The volume of the stationary capillary element 919 and the nib 905 may be such as to store a minimum amount of fluid.

The fluid delivery system may include a plurality of reciprocating capillary elements 925, 927, 929, and 931. There may be one reciprocating capillary element for the delivery of clear fluid into the clear fluid lumen 923, such as the reciprocating capillary element 931. There may be an additional reciprocating capillary element for each of the colors of ink, such as the reciprocating capillary elements 925, 927, and 929.

Each reciprocating capillary elements may be configured to deliver ink and may have a flat surface that is configured to abut one of the flat surfaces of the stationary capillary element 919, as illustrated in FIGS. 9*e*-9*f*. These elements are referred to as reciprocating, because they may move longitudinally with respect to the capillary element 919. To effectuate this, each of the reciprocating capillary elements may be connected to one of the color selection sliders.

Similarly, the reciprocating capillary element 931 may be configured to slidingly engage the clear fluid lumen 923 in an adjustable amount, based on the setting of the dilution control 907. The dilution control 907 may be threadingly engaged with the tubular housing 901 to effectuate longitudinal movement of the reciprocating capillary element 931 by rotation of the dilution control 907. It may instead merely move longitudinally without rotation.

The tubular housing 901 may be configured to house the ink reservoirs and the fluid delivery systems. The tubular housing may be of any type, such as any of the types discussed elsewhere in this application.

All other aspects of the multicolor writing and painting instruments which are illustrated in FIGS. 9*a*-9*g* may be the same as those illustrated and discussed above in connection with FIGS. 8*a*-8*j*. One difference, however, may be that the instrument illustrated in FIGS. 9*a*-9*h* may have the ability to deliver more than two colors simultaneously to the nib 905.

Figure 10A:
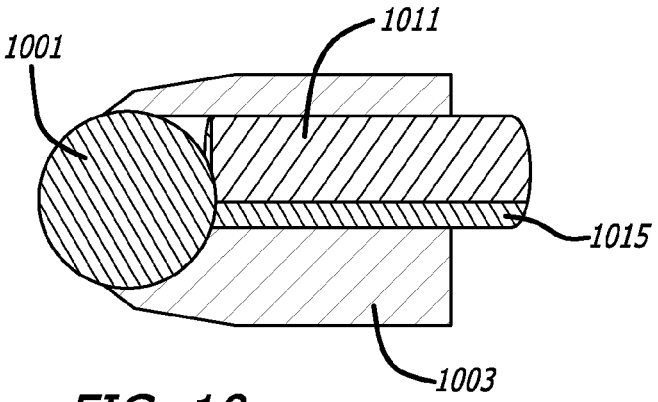
FIGS. 10*a*-10*d* illustrate a multicolor writing and painting instrument with a single roller ball functioning as a nib and ink-receiving surface that is fed with user-selected colored ink(s) from a rotatable multi-section capillary cylinder that has a central axis that is offset from the center of the roller ball.
Figure 10C:
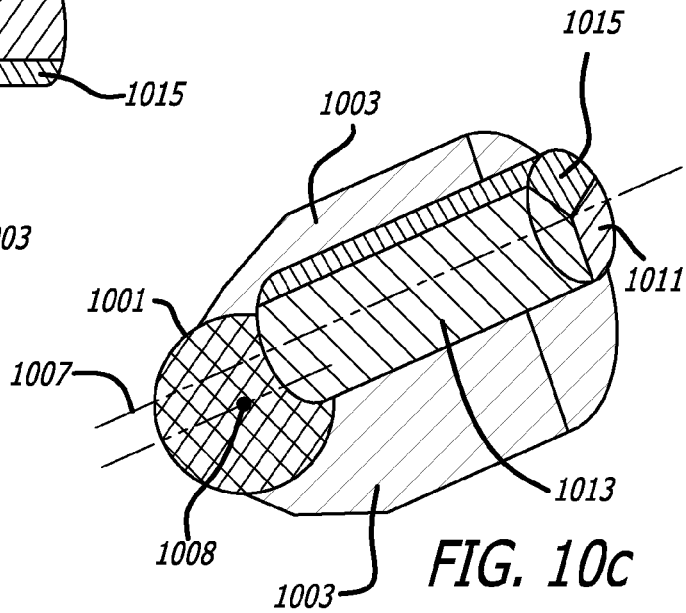
Figure 10B:
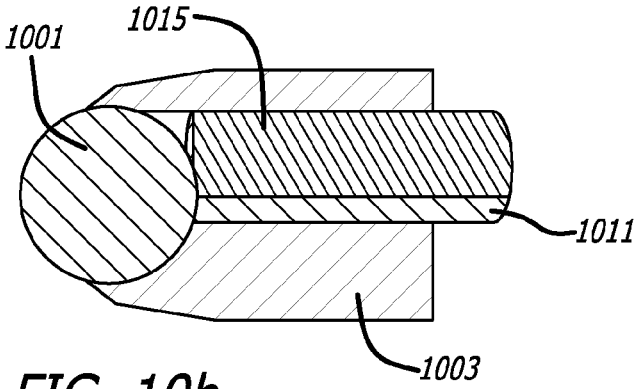

FIGS. 10*a*-10*c* illustrate a multicolor writing and painting instrument with a single roller ball functioning as a nib and ink-receiving surface that is fed with user-selected colored ink(s) from a rotatable multi-section capillary cylinder that has a central axis that is offset from the center of the roller ball.

This instrument may include a roller ball 1001 mounted within a roller ball housing 1003. The roller ball housing 1003 may include a rearward cylindrical lumen 1005 that has a central access 1007 that is slightly offset from the center 1008 of the roller ball 1001. Within the rearward cylindrical lumen may be a multi-section capillary cylinder 1009 that may be formed from a plurality of capillary cylinder sectors, one for each desired color of ink, such as capillary cylinder sectors 1011, 1013, and 1015. Each capillary cylinder sector may have a sector-like end surface that may engage an ink-receiving surface at the rear of the roller-ball 1001 when positioned behind it.

The roller ball 1001 may be of any type, including any of the types discussed elsewhere in this application.

The roller ball housing 1003 may be of any type, may be made of any material, and may have any size.

Any number of colors and associated cylinder sectors may be used. In one embodiment, the three primary colors may be used, and thus three cylinder sectors may be used.

Each cylinder sector may be of any type. For example, each cylinder sector may be any of the types discussed above in connection with the cylinder sectors illustrated in FIGS. 8*a*-8*j*.

A fluid delivery system may be used to fluidically connect each cylinder sector to its own ink reservoir. The fluid delivery systems may be of any type, including any of the types discussed elsewhere in this application.

The ink reservoirs may be of any type, including any of the types discussed elsewhere in this application. Each ink reservoir may contain a different colored ink. Any colors may be used, including any of the colors and color sets discussed elsewhere in this application. When three ink reservoirs are use, for example, each may be filled with one of the primary colors.

A color selection control may be configured to rotate the roller ball housing 1003 with respect to the multi-section capillary cylinder 1009. When a cylindrical housing is used to house the components of the instrument, for example, the roller ball housing 1003 may be configured to remain stationary within the housing, while the multi-section capillary cylinder is rotated by the color selection control. A color selection control such as is illustrated in FIGS. 8*a*-8*j* may, for example, be used for this purpose. In an alternate embodiment, the multi-section capillary cylinders 1009 may remain stationary with respect to the tubular housing, while the roller ball housing 1003 is rotated by the color selection control.

Color indicators may similarly be provided to indicate the relative rotation position between the roller ball housing 1003 and the multi-section capillary cylinder 1009. They may be of any type, such as one of the types discussed in connection with FIGS. 8*a*-8*j*.

A tubular housing may be provided and configured to house the ink reservoirs and the fluid delivery systems. The tubular housing may be of any type, such as any of the types discussed elsewhere in this application.

The color selection control may be adjusted to cause any desired color to be written by the instrument illustrated in FIGS. 10*a*-10*c*. In FIG. 10*a*, for example, the color selection control has been adjusted to cause only the sector-like end surface of the capillary cylinder sector 1015 to engage the ink-receiving surface of the roller ball 1001. FIG. 10*b* is the same, except that the multi-section capillary cylinder 1009 has been rotated such that the sector-like end surface of the cylinder sector 1013 engages the ink-receiving surface of the roller ball 1001.

Figure 10D:
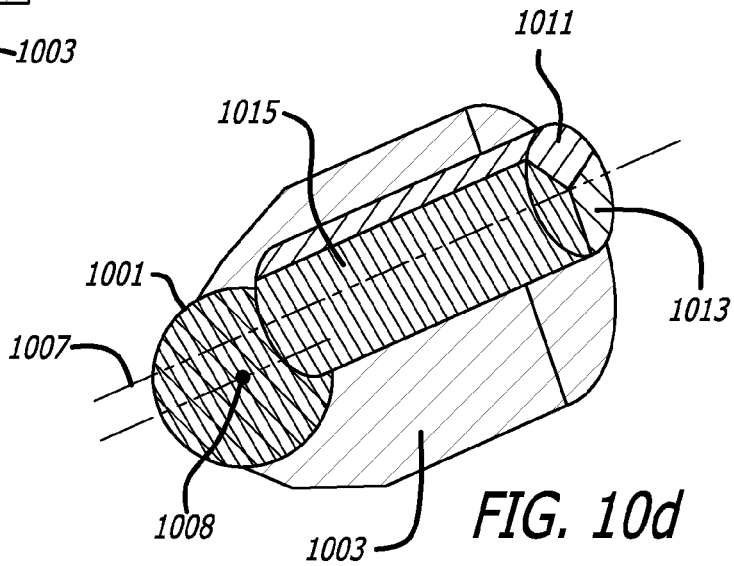

FIG. 10*c* is the same, except that the multi-section capillary cylinder 1009 has been rotated such that half of the sector-like end surfaces of the cylinder sectors 1013 and 1015 engage the ink-receiving surface of the roller ball 1001, thus causing an equal mixture of their inks to be mixed by the roller ball 1001 and delivered to its tip. FIG. 10*d* is the same, except that a different neighboring set of section-like end surfaces have been oriented to engage the ink-receiving surface of the roller ball 1001, thus causing a different color to be delivered to the tip of the roller ball 1001. The color selector control may also be adjusted to cause unequal portions of the sector-like end surfaces of two neighboring cylinder sectors to touch the ink-receiving surface behind the roller ball 1001, thus allowing any other color to be delivered.

Figure 11A:
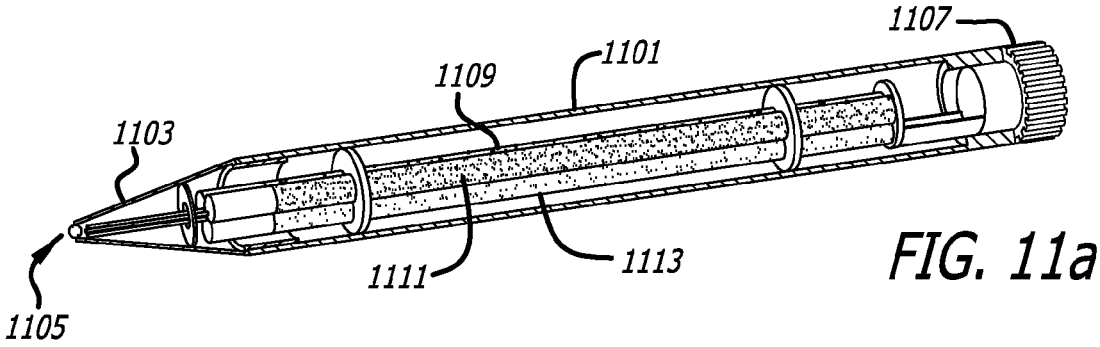
FIGS. 11*a* and 11*b* are cut-away side and top views, respectively, of a multicolor writing and painting instrument with a single nib fed with user-selected colored ink(s) that uses a fluid delivery system having reciprocating capillary elements that are controlled by a rotating knob.
Figure 11B:
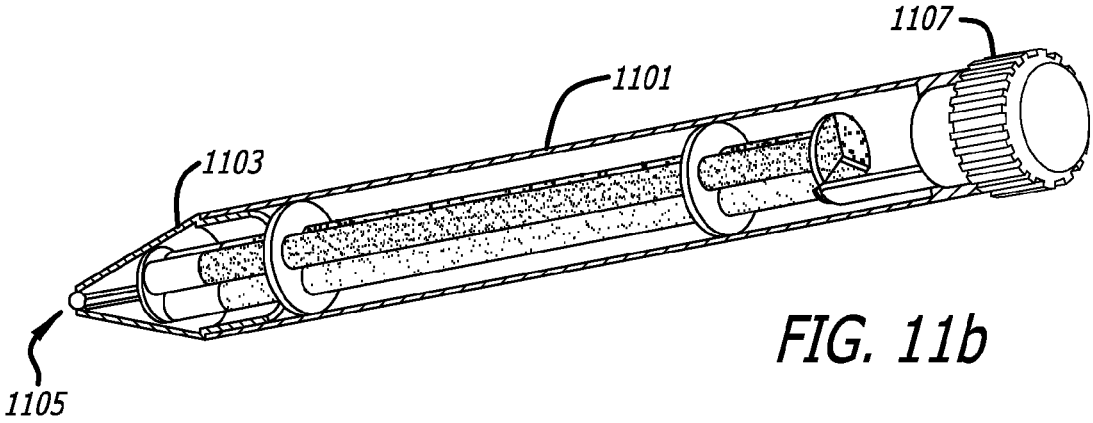
Figure 11C:
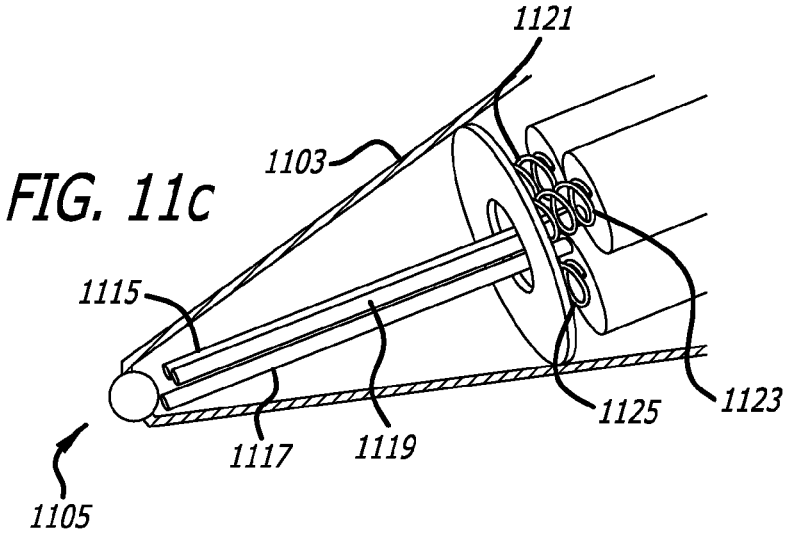
FIG. 11*c* is the lower portion of the multicolor writing and painting instrument illustrated in FIGS. 11*a* and 11*b*.
Figure 11D:
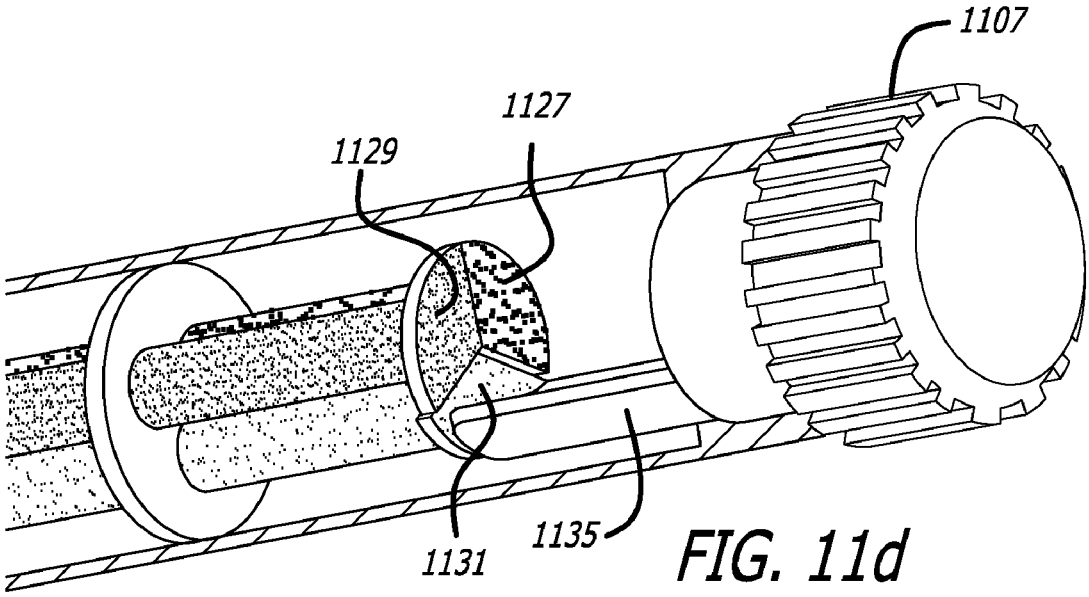
FIG. 11*d* illustrates the rotatable knob of the color selection control in the multicolor writing and painting instrument illustrated in FIGS. 11*a* and 11*b*.

FIGS. 11*a* and 11*b* are cut-away side and top views, respectively, of a multicolor writing and painting instrument with a single nib fed with user-selected colored ink(s) that uses a fluid delivery system that includes reciprocating capillary elements that are controlled by a rotating knob. FIG. 11*c* is the lower portion of the multicolor writing and painting instrument illustrated in FIGS. 11*a* and 11*b*. FIG. 11*d* illustrates the rotatable knob of the color selection control in the multicolor writing and painting instrument illustrated in FIGS. 11*a* and 11*b*.

This instrument may include a tubular housing 1101 having a tapered portion 1103 supporting a single nib 1105. The instrument may also include a color selector control 1107.

The nib 1105 may be any of the types of nibs that have been discussed elsewhere in this application. For example, the nib 1105 may be a roller ball nib.

The instrument may include ink reservoirs 1109, 1111, and 1113. A different number of ink reservoirs may be used instead, such as two, three, five, six, or more. The ink reservoirs may be of any type, including any of the types discussed elsewhere in this application.

Each ink reservoir may contain a different colored ink. Any colors may be used, including any of the colors and color sets discussed elsewhere in this application. When three ink reservoirs are use, for example, each may be filled with one of the primary colors.

A fluid delivery system may be used to deliver ink from each ink reservoir to an ink-receiving surface behind the nib 1105. The fluid delivery systems may be of any type, including any of the types of fluid delivery systems that are discussed elsewhere in this application.

The fluid delivery system may include a reciprocating element for each ink reservoir, such as reciprocating elements 1115, 1117, and 1119. Each reciprocating element may have a fluid delivery tip which may be controllably engaged with or disengaged from the ink receiving surface behind the nib 1105, as illustrated in FIG. 11*b*. A spring may be used in connection with each reciprocating element to urge the reciprocating element away from the ink-receiving surface of the nib 1105, such as springs 1121, 1123, and 1125. The actuation of each reciprocating element may be controlled by the depression of a cam surface, such as cam surfaces 1127, 1129, and 1131. Each cam surface may be selectively depressed by a rotatable cam 1135 coupled to the color selector control 1107. The rotatable cam 1135 may be configured to allow one or two cam surfaces to be simultaneously depressed.

The tubular housing 1101 may be configured to house the ink reservoirs and the fluid delivery systems. The tubular housing may be of any type, such as any of the types discussed elsewhere in this application.

Color selection indicia may be provided to signal to the user the color at which the instrument has been set to write. The color selection indicia may be of any type, such as any of the types discussed elsewhere in this application.

Figure 12:
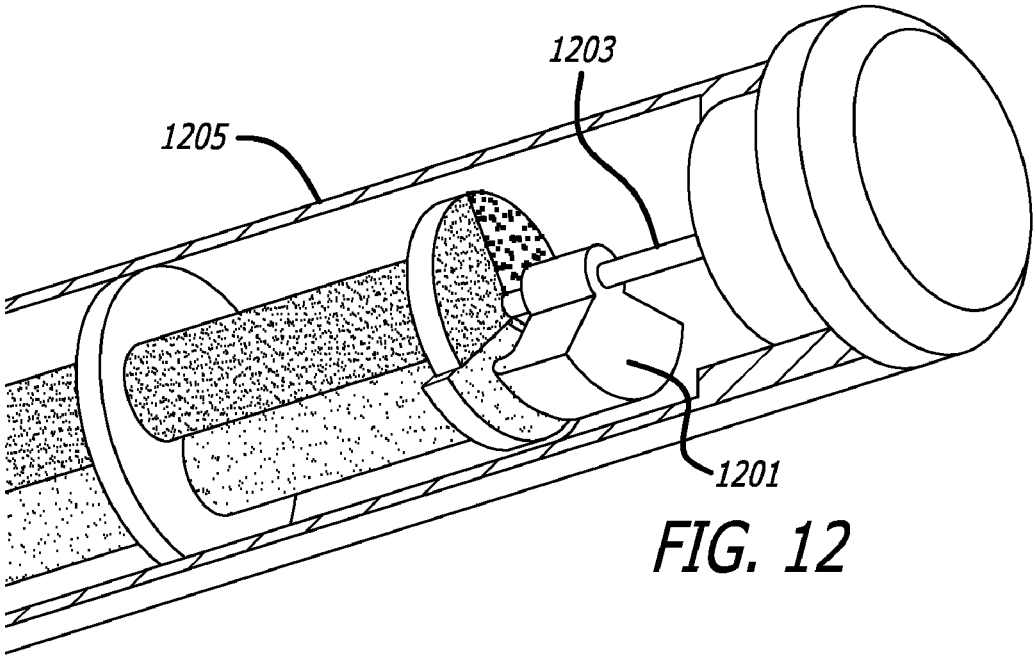
FIG. 12 is a cut-away view of a color selection control in a multicolor writing and painting instrument with a single nib fed with user-selected colored ink(s) that uses a fluid delivery system that includes reciprocating capillary elements that are automatically controlled by the rotational position of the instrument.

FIG. 12 is a cut-away view of a color selection control in a multicolor writing and painting instrument with a single nib fed with user-selected colored ink(s) that uses a fluid delivery system that includes reciprocating capillary elements that are automatically controlled by the rotational position of the instrument.

This instrument may be the same as the one illustrated in FIGS. 11*a*-11*d*, except that the rotatable cam 1135 may be replaced by a free-wheeling weight 1201 which may be rotatably mounted to a central shaft 1203. In this configuration, the free-wheeling weight may always be pulled down by gravity to its lowest position, thus applying force to the cam surface that lies beneath it. Thus, any one or two cam surfaces may be actuated merely by rotating the instrument to a different position.

Color selection indicia may be provided to communicate to the user the color the instrument is positioned to write, such as any of the color selection indicia that are discussed elsewhere in this application in connection with FIGS. 1*a*, 2*a*, 4*a*-4*b*, 5, 6*a*-6*c*, and 7*a*-7*c*. The tubular housing 1205 may have a form factor help the user in identifying which color the instrument is positioned to write and to help stabilize that selected color, such as one of the form factors illustrated in FIGS. 4*a*-4*b*, 5, 6*a*-6*c*, and 7*a*-7*c*.

A locking mechanism may be provided to lock and unlock the position of the free-wheeling weight 1201. For example, the locking mechanism may be configured to unlock the free-wheeling weight 1201 when the instrument is horizontally positioned, thus allowing the user to select a desired color by rotating the instrument while in this horizontal position. The locking mechanism may be configured to lock the free-wheeling weight 1201 when the instrument is moved to a tilted (i.e., writing) position, thus preventing changes in color from accidentally being made while writing.

Figure 13A:
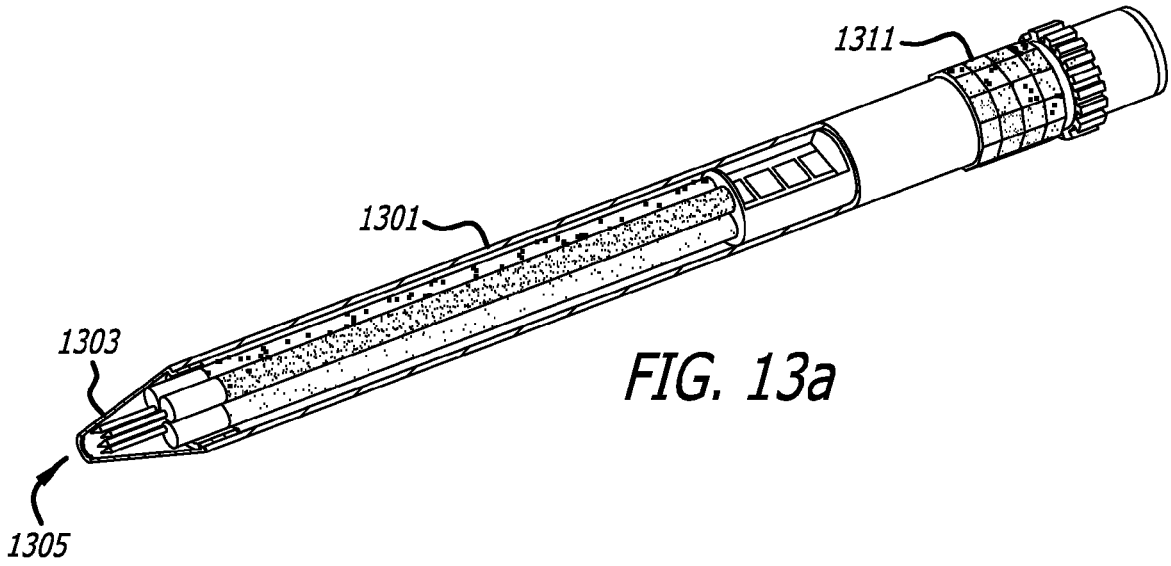
FIG. 13*a* is a cut away view of a multicolor writing and painting instrument with a single nib fed that uses droplet dispensing mechanisms configured to selectively deliver colored ink to an ink-receiving surface.
Figure 13B:
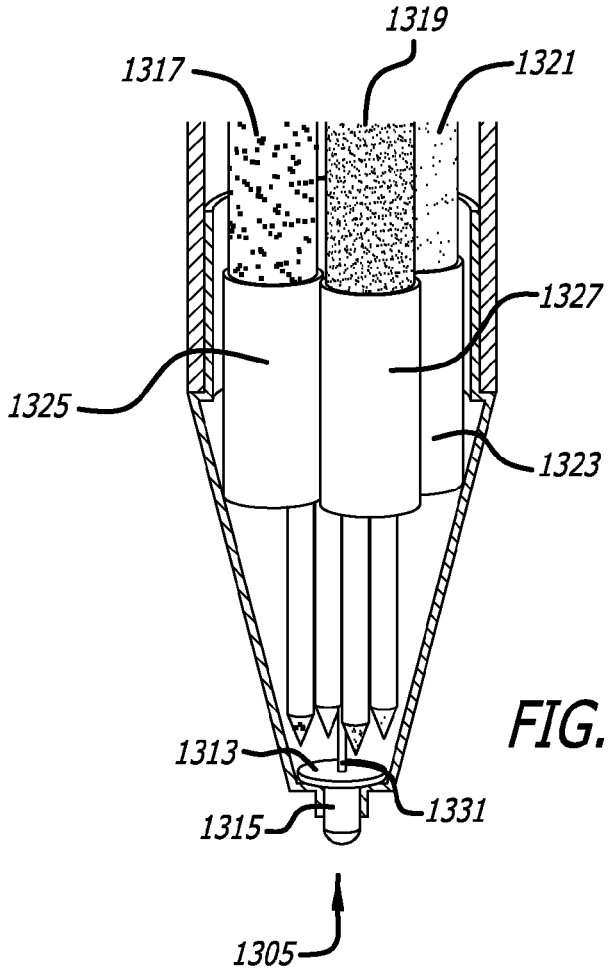
FIG. 13*b* illustrates the lower portion of the multicolor writing and painting instrument illustrated in FIG. 13*a*.

FIG. 13*a* is a cut away view of a multicolor writing and painting instrument with a single nib fed that uses droplet dispensing mechanisms configured to selectively deliver colored ink to an ink-receiving surface. FIG. 13*b* illustrates the lower portion of the multicolor writing and painting instrument illustrated in FIG. 13*a*.

This instrument may include a tubular housing 1301 having a tapered portion 1303 supporting a single nib 1305. The instrument may include a color selector control 1311.

The nib 1305 may be any type of nib, such as any of the types of nibs discussed elsewhere in this application. For example, the nib may have an ink receiving surface 1313 which may be made of capillary material. The nib 1305 may instead be instead a roller ball nib.

A capillary or other type of intervening fluid communicating element 1315 may delivers ink to the nib 1305 from the ink-receiving surface 1313.

A plurality of ink reservoirs may be used, such as ink reservoirs 1317, 1319, 1321 and a forth reservoir which is not very visible in the drawings. Each reservoir may be filled with a different colored ink. When three reservoirs are used, for example, they may be filled with ink having one of the primary colors. The ink reservoirs may be of any type, such as one of the types discussed elsewhere in this application.

A fluid delivery system may be used to controllably deliver ink from one or more of the reservoirs to the ink-receiving surface 1313. The fluid delivery systems may be of any type, including any of the types of fluid delivery systems that are discussed elsewhere in this application.

The fluid delivery systems may include a droplet dispensing mechanism for each of the ink reservoirs, such as droplet dispensing mechanisms 1323, 1325, 1327, and a forth mechanism which is not very visible in the drawings. Each may be configured to utilize ink jet technology to deliver ink from their respective ink reservoirs to the ink-receiving surface 1313. Each ink drop dispensing mechanism may include or consist of a solenoid valve, a piezo-electric valve, and/or a bubble jet mechanism.

The intervening element 1315 and/or the nib 1305 may be configured to mix the inks which are delivered to the ink-receiving surface 1313.

A fluid sensor 1331 may be provided to detect excess fluid on the ink-receiving surface 1313. The fluid sensors may include electrodes which measure the resistivity across an area of the ink-receiving surface 1313 and/or may utilize any other or additional means to measure this fluid.

The tubular housing 1301 may be configured to house the ink reservoirs and the fluid delivery systems. The tubular housing 1301 may be of any type, such as any of the types discussed elsewhere in this application.

The color selection control 1311 may include a matrix of colored surfaces. The color selection control 1311 may be configured such that pressing a colored surface activates a corresponding switch that sends a signal to drive electronics informing it of the color selection and causing the appropriate mixture of colors to be ejected by the droplet dispensing mechanisms.

The instrument may set the frequency of the droplets for each basic color in such a way that the desired color results at the nib 1305. For example, if a selected color requires 70% magenta and 30% cayenne, the droplet dispensing mechanism for magenta ink may be set to operate at 700 hertz while the droplet dispensing mechanism for the cayenne ink may be set to operate at 300 hertz for the duration of the writing. When the writing stops, the fluid accumulation on the ink-receiving surface 1313 may be sensed and the dispensing actuators may be stopped. As soon as the writing resumes and the fluid level on the ink-receiving surface 1313 diminishes, the appropriate droplet dispensing mechanisms may be actuated to resume their deposition.

Microcontroller-based electronics and battery may be used. The batteries may be configured to supply the needed energy for the electronics and the actuators. The microcontroller may include a memory and program that may be configured to print interesting patterns of colors and color changes during writing. A user control may be provided to select a desired pattern.

Figure 14:
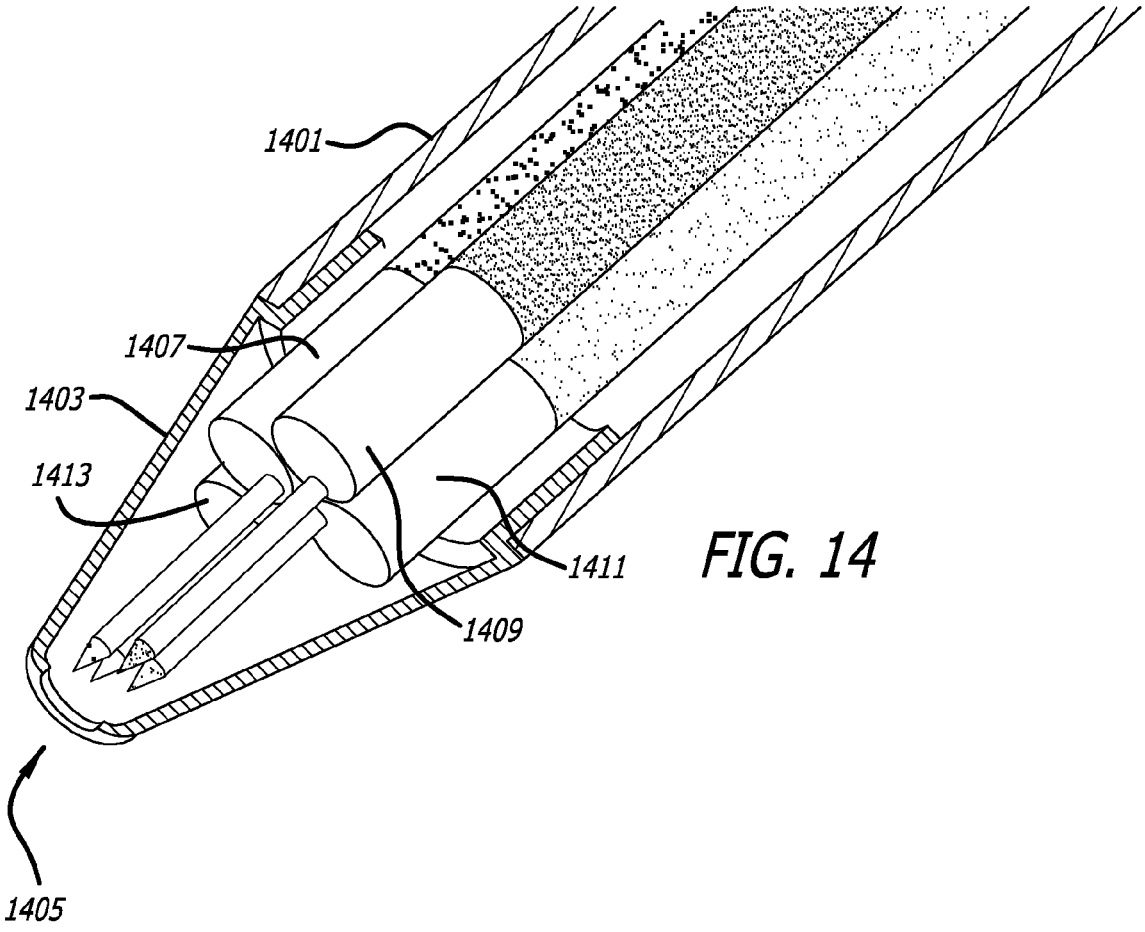
FIG. 14 is a cut away view of a the lower portion of a multicolor writing and painting instrument with a lower, open-ended tubular housing that uses droplet dispensing mechanisms configured to selectively deliver colored ink directly to a writing surface.

FIG. 14 is a cut away view of a the lower portion of a multicolor writing and painting instrument with a lower, open-ended tubular housing that uses droplet dispensing mechanisms configured to selectively deliver colored ink directly to a writing surface.

This instrument may include a tubular housing 1401 having a tapered portion 1403 with an opening 1405 at its end. Droplet dispensing mechanisms, such as droplet dispensing mechanisms 1407, 1409, 1411, and 1413. Each may be configured to spray droplets through the opening 1405 and onto a point on a writing surface on which the end of the tapered section 1403 has been placed.

A solid ink (such as those made with mixing paraffin with color pigments) may be used to avoid ink drying at the ink jetting heads due to exposure to air. The paraffin-based ink may first be melted by a small amount of ink delivered by an electric heating element and then jetted from a droplet dispensing mechanism.

The instrument may be configured to begin operating when the tip of the tapered portion 1403 touches a writing surface. A proximity sensor (e.g., an optical sensor) or a pressure transducer may be used to detect this touching.

All other aspects of the multicolor writing and painting instrument that is illustrated in FIG. 14 may be the same as those that have been discussed above in connection with FIGS. 13*a* and 13*b*.

Figure 15:
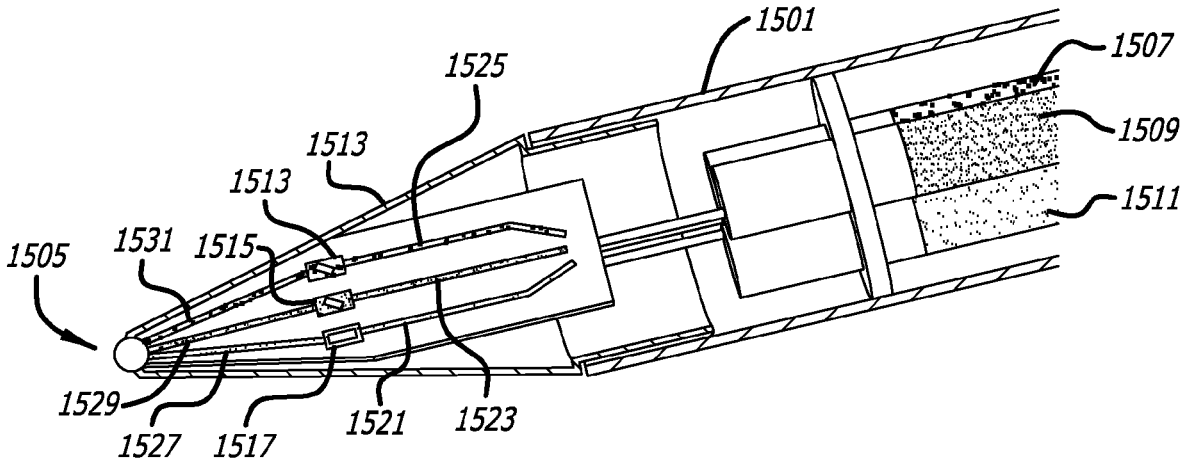
FIG. 15 is a cut away view of the lower portion of a multicolor writing and painting instrument with a single nib fed with user-selected colored ink(s) controlled by microfluidic valves.

FIG. 15 is a cut away view of the lower portion of a multicolor writing and painting instrument with a single nib fed with user-selected colored ink(s) controlled by micro-fluidic valves.

This instrument may include a tubular housing 1501 having a tapered section 1503 supporting a single nib 1505.

The nib 1505 may be of any type, including any of the types discussed elsewhere in this application.

The instrument may include one or more ink reservoirs, each holding a different color ink, such as ink reservoirs 1507, 1509, and 1511. A different number of ink reservoirs may be used instead, such as two, three, five, six, or more. The ink reservoirs may be of any type, including any of the types discussed elsewhere in this application.

Each ink reservoir may contain a different colored ink. Any colors may be used, including any of the colors and color sets discussed elsewhere in this application. When three ink reservoirs are use, for example, each may be filled with one of the primary colors.

A fluid delivery system may be used to controllably deliver ink from one or more of the reservoirs to an ink-receiving surface behind the nib 1505. The fluid delivery systems may be of any type, including any of the types of fluid delivery systems that are discussed elsewhere in this application.

The fluid delivery systems may include a micro-fluidic valve to regulate the flow of fluid from each ink reservoir to the ink-receiving surface, such as the micro-fluidic valves 1513, 1515, and 1519. Micro-fluidic channels may be used to communicate fluid to and from each micro-fluidic valve, such as micro-fluidic channels 1521, 1523, 1525, 1527, 1529, and 1531.

The tubular housing 1501 may be configured to house the ink reservoirs and the fluid delivery systems. The tubular housing may be of any type, such as any of the types discussed elsewhere in this application.

A color selection control may be provide to enable a user to select one or more of the colored inks and to cause the fluid delivery system to deliver the selected colored to the ink-receiving surface.

Color selection indicia may be provided to signal to the user the color at which the instrument has been oriented to write. The color selection indicia may be of any type, such as any of the types discussed elsewhere in this application.

Figure 16A:
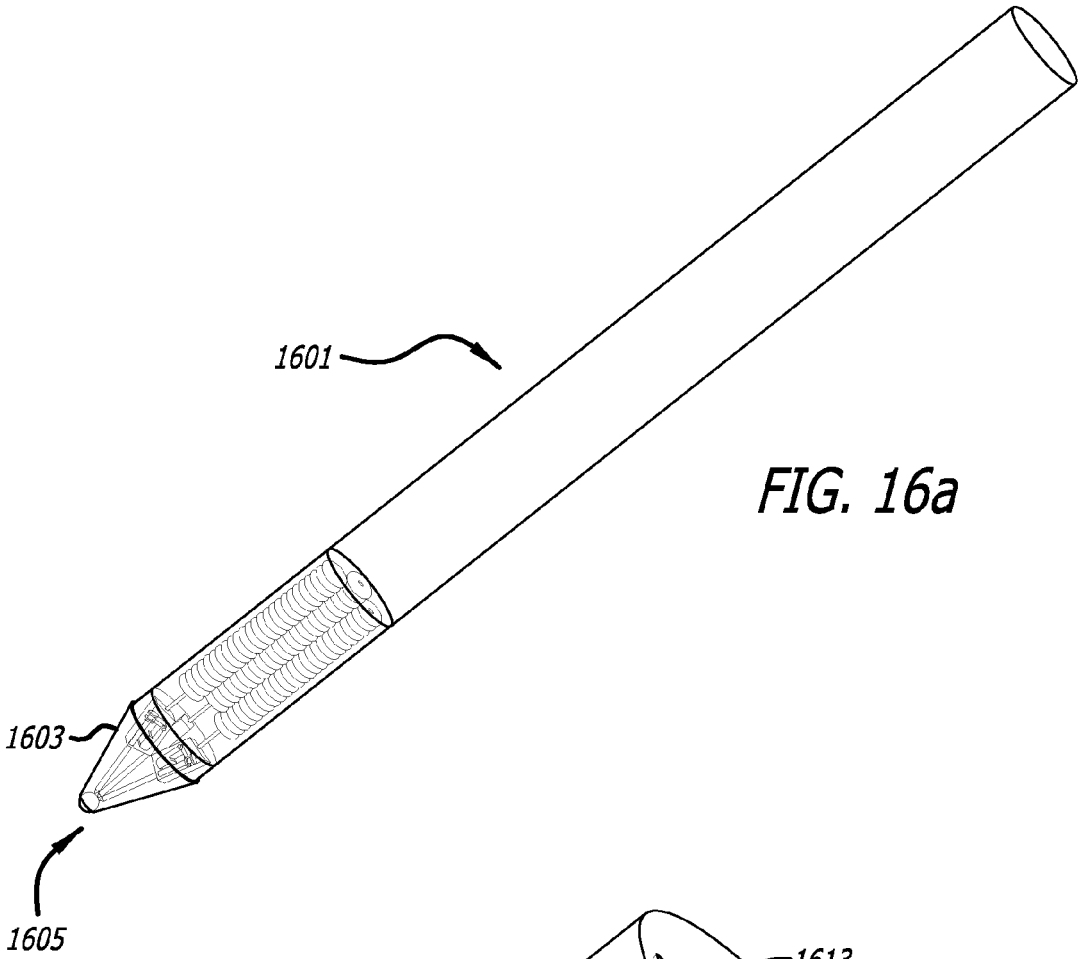
FIG. 16*a* illustrates a multicolor writing and painting instrument with a single nib fed with user-selected colored ink(s) controlled by a color selection control that uses pivoting weights to automatically select the colored ink based on the rotational position of the instrument.
Figure 16B:
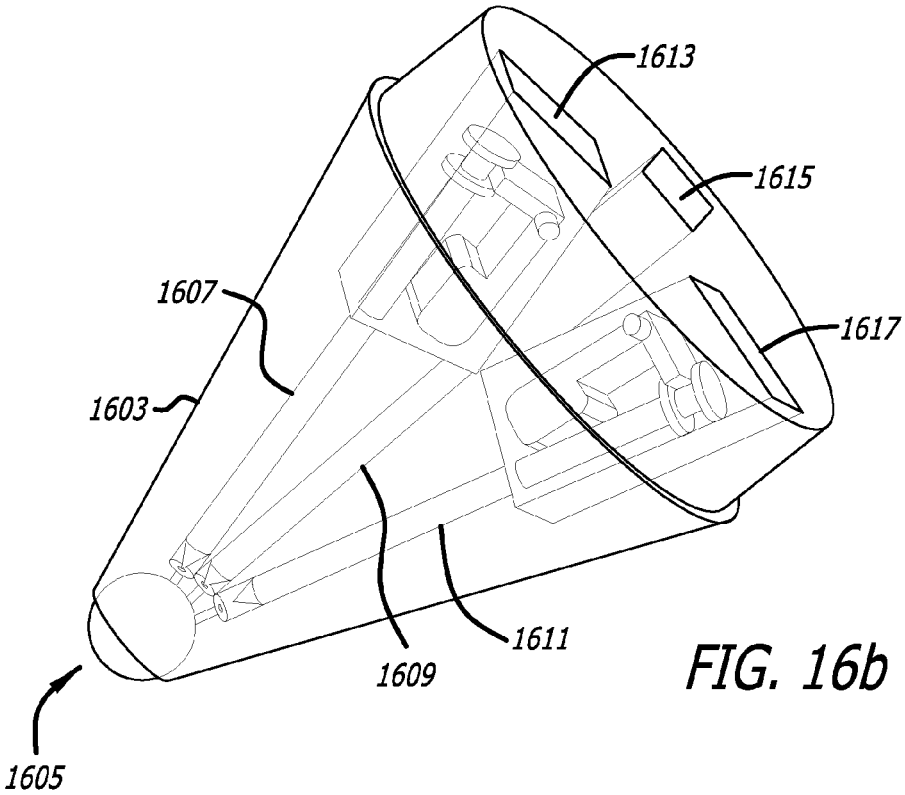
FIG. 16*b* illustrates the lower portion of the conical portion of the tubular housing in the multicolor writing and painting instrument illustrated in FIG. 16*a*.
Figure 16C:
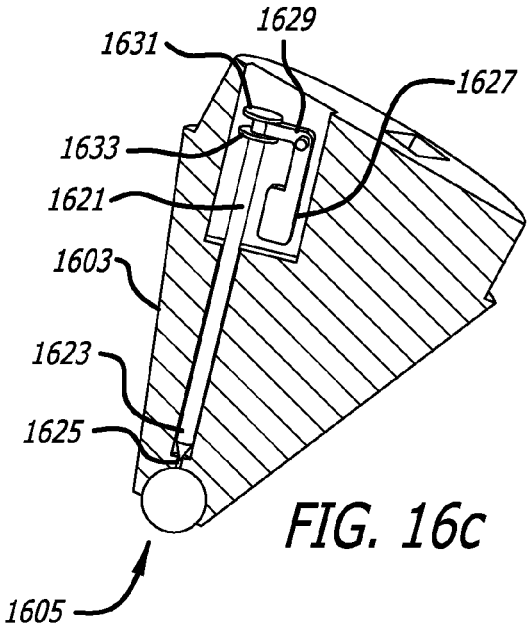
FIG. 16*c* illustrates a pivoting weight in the multicolor writing and painting instrument illustrated in FIG. 16*a* in a closed position.
Figure 16D:
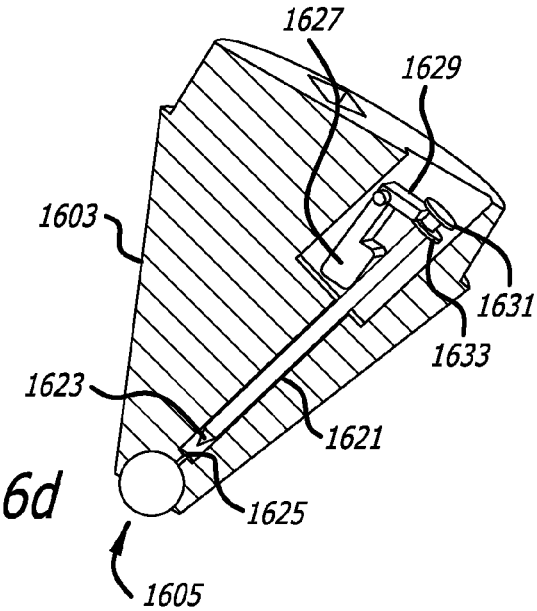
FIG. 16*d* illustrates a pivoting weight in the multicolor writing and painting instrument illustrated in FIG. 16*a* in an open position.
Figure 16E:
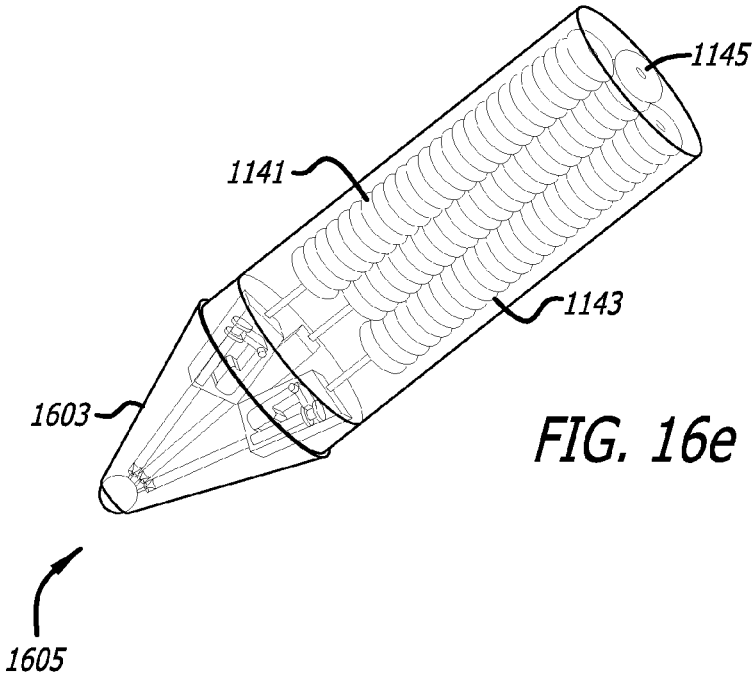
FIG. 16*e* illustrates disk-shaped cavities in the multicolor writing and painting instrument illustrated in FIG. 16*a*.

FIG. 16*a* illustrates a multicolor writing and painting instrument with a single nib fed with user-selected colored ink(s) controlled by a color selection control that uses pivoting weights to automatically select the colored ink based on the rotational position of the instrument. FIG. 16*b* illustrates the lower portion of the conical portion of the tubular housing in the multicolor writing and painting instrument illustrated in FIG. 16*a*. FIG. 16*c* illustrates a pivoting weight in the multicolor writing and painting instrument illustrated in FIG. 16*a* in a closed position. FIG. 16*d* illustrates a pivoting weight in the multicolor writing and painting instrument illustrated in FIG. 16*a* in an open position. FIG. 16*e* illustrates disk-shaped cavities in the multicolor writing and painting instrument illustrated in FIG. 16*a*.

This instrument may include a tubular housing 1601 having a tapered portion 1603 and a single nib 1605.

The nib 1605 may be of any type, such as any of the types of nibs discussed elsewhere in this application. For example, the nib 1605 may be a roller ball nib or a capillary element.

The instrument may include one or more ink reservoirs, such as three ink reservoirs. A different number of ink reservoirs may be used instead, such as two, three, five, six, or more. The ink reservoirs may be of any type, including any of the types discussed elsewhere in this application.

Each ink reservoir may contain a different colored ink. Any colors may be used, including any of the colors and color sets discussed elsewhere in this application. When three ink reservoirs are use, for example, each may be filled with one of the primary colors.

A fluid delivery system may be used to controllably deliver ink from one or more of the reservoirs to an ink-receiving surface behind the nib 1605. The fluid delivery systems may be of any type, including any of the types of fluid delivery systems that are discussed elsewhere in this application.

The fluid delivery system may include a plurality of ink delivery channels configured to deliver ink to the ink-receiving surface, such as ink delivery channels 1607, 1609, and 1611. Each ink delivery channel may have a feed lumen for receiving ink, such as a feed lumen 1613 for ink delivery channel 1607, a feed lumen 1615 for ink delivery channel 1609, and a feed lumen 1617 for ink delivery channel 1611.

Within each ink delivery channel may be a micro valve configured to regulate the flow of ink from the feed lumen in the ink-delivery channel to the end of the channel at which ink may be directed to the ink-receiving surface behind the nib 1605. Each micro valve may include a valve pin, such as a valve pin 1621. The valve pin may have a conical tip, such as a conical tip 1623. When the valve pin 1621 is fully down, as illustrated in FIG. 16*c*, the conical tip may fully fill an exit channel in the valve, such as an exit channel 1625, thus closing the valve. When the valve pin is raised, such as illustrated in FIG. 16*d*, fluid may flow through the channel and, in turn, to the ink-receiving surface behind the nib 1605. The channel may have a diameter larger than the diameter of the valve pin to facilitate this flow.

A pivoting weight, such as a pivoting weight 1627, may be used in connection with each micro valve. The pivoting weight may have an arm, such as an arm 1629, that engages flanges, such as flanges 1631 and 1633. The pivoting weight may cause the valve pin to close the valve when the instrument is rotated such that the weight move away from the pin as illustrated in FIG. 16*c*. Conversely, the pivoting weight may cause the valve pin to open the valve when the instrument is rotated such that the weight move towards the pin as illustrated in FIG. 16*d*.

A laser-based Direct-Write Fabrication Process may be used to fabricate the nib, the ink delivery channels, the feed lumens, the valve pins, the conical tips, the pivoting weights, the arms of the pivoting weights, the flanges, the disc-shaped cavities and/or all of the structures relating them. This process may engrave the contours of these components and features directly into a glass material using a laser. The engraving may selectively alter the characteristics of the regions that define these components and features, including needed spaces, using special, laser-sensitive glass. The laser-treated glass may then be chemically etched to remove the regions treated by the laser.

Color selection indicia may be provided to signal to the user the color at which the instrument has been oriented to write. The color selection indicia may be of any type, such as any of the types discussed elsewhere in this application.

The fluid delivery system may include disc-shaped cavities, such as disc-shaped cavities 1641, 1643, and 1645. These may be used to regulate the flow of ink to each of the micro-valves.

Other types of valves may be used in addition or instead. For example, a valve may be actuated by air or fluid pressure. Pneumatic or fluid power may be supplied by a weight which presses against closed air or fluid bags. Another way to actuate micro-fluidic valves may be by a small permanent magnet that is positioned above the valve which is desired to be open. The valve may be made or have attached to it iron, nickel, or other magnetic materials. The magnet may be moved, again by means of a weight, always driven by downward gravity as the instrument body is rotated.

The valves may instead operate by electric power in which case switching may be done by means of a weight which activates valve switches as the instrument is rotated to a desired orientation.

Alternatively, manual buttons may be used to select a desired ink channeling configuration.

In electronic versions, proportional valves may use pulse-width modulations (PWM) control to control the ink flow rate. Another method for flow control may be the use of multiple parallel channels for each ink color. The number of open channels may determine the overall flow rate of the ink. Other types of devices may be used to electronically operate the valves, such as devices which work with electromagnetics (e.g., solenoids and relays) capacitance, piezo-electric properties, shape memory alloys, or polymers.

Thousands of micro-fluidic circuits may be etched in a mass production setting. An electronically operated circuit may use a small button lithium battery.

The figures discussed above describe several embodiments of multi-colored pens, including several variations of each embodiment, such as variations in sizes, shapes, material composition, number, functions, and component selection. Each embodiment includes a combination of components. Each of the components in one embodiment may be replaced by the corresponding component from any other embodiment. Each of the components from any one of the embodiments may also be added to each of the other embodiments when the other embodiment lacks a corresponding component. For example, the multiple nibs in one embodiment may be replaced by one of the single nibs in one of the other embodiments. Similarly, the color selection indicia, ink and clear fluid reservoirs, inks, and fluid delivery systems in one embodiment may be replaced by the corresponding color selection indicia, ink and clear fluid reservoirs, inks, and fluid delivery system from each of the other embodiments. The only exception to these variations is when the change or addition would not be compatible.

The components, steps, features, objects, benefits and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, objects, benefits and advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The phrase "means for" when used in a claim is intended to and should be interpreted to embrace the corresponding structures and materials that have been described and their equivalents. Similarly, the phrase "step for" when used in a claim embraces the corresponding acts that have been described and their equivalents. The absence of these phrases means that the claim is not intended to and should not be interpreted to be limited to any of the corresponding structures, materials, or acts or to their equivalents.

Nothing that has been stated or illustrated is intended or should be interpreted to cause a dedication of any component, step, feature, object, benefit, advantage, or equivalent to the public, regardless of whether it is recited in the claims.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents.

The invention claimed is:

1. A multicolor writing and painting instrument comprising:

a tubular housing sized and shaped to be held by fingers of a user;

a single, hard, wear-resistant nib at an end of the tubular housing, the nib having:

a substantially-curved writing surface; and a plurality of tubes which each lead to the substantially-curved writing surface of the nib, the tubes forming a plurality of openings on the writing surface, the openings arranged in clusters of one or more openings, each cluster of openings lying approximately along a circumference of a common circle, the substantially-curved writing surface on the nib and the openings on them being configured so as to cause ink at only a subset of the openings to come in contact with a flat writing surface at any one time;

a separate ink reservoir within the tubular housing for each cluster of openings; and a fluid delivery system within the tubular housing connected between each ink reservoir and the tubes which form the openings of one of the clusters of openings and configured to deliver fluid from the reservoir to which it is connected to the tubes to which it is connected.

2. The multicolor writing and painting instrument of claim 1 wherein the nib is made of glass.

3. The multicolor writing and painting instrument of claim 1 wherein the nib is made of ceramic.

4. The multicolor writing and painting instrument of claim 1 wherein the nib is made of metal.

5. The multicolor writing and painting instrument of claim 1 wherein each cluster includes more than one opening, and wherein each cluster of openings is spaced apart from the other clusters of openings such that each opening in a cluster is closer to another opening in the cluster than to an opening in any other cluster.

6. The multicolor writing and painting instrument of claim 1 wherein each tube is configured to transfer fluid by capillary action.

7. The multicolor writing and painting instrument of claim 1 wherein each fluid delivery system includes a capillary element configured to transfer fluid by capillary action.

8. The multicolor writing and painting instrument of claim 1 wherein the tubes which form the openings of each of the clusters of openings lead to an ink distribution hub that is separate from all of the other ink distribution hubs.

9. The multicolor writing and painting instrument of claim 1 wherein each reservoir contains a different colored ink.

10. The multicolor writing and painting instrument of claim 9 wherein there are three and only three clusters of openings and reservoirs.

11. The multicolor writing and painting instrument of claim 10 wherein one of the reservoirs contains yellow ink, another cyan ink, and the other magenta ink.

12. The multicolor writing and painting instrument of claim 1 wherein there are two and only two clusters of openings, ink reservoirs, and fluid delivery systems.

13. The multicolor writing and painting instrument of claim 1 wherein there are three and only three separated clusters of openings, ink reservoirs, and fluid delivery systems.

14. The multicolor writing and painting instrument of claim 1 further comprising color selection indicia on the surface of the tubular housing that is configured to communicate to the user the color the instrument is positioned to write.

15. The multicolor writing and painting instrument of claim 14 wherein the color selection indicia includes a color selection indicia for each of the clusters of openings, and wherein each color selection indicia extends across only a portion of the perimeter of the cross-section of the tubular housing and is located opposite in rotational position to that cluster of openings.

16. The multicolor writing and painting instrument of claim 15 wherein each color selection indicia for a cluster of openings includes a visual color that is approximately the same as the colored ink delivered to the tubes which lead to that cluster of openings.

17. The multicolor writing and painting instrument of claim 1 wherein the tubular housing has a plurality of substantially flat longitudinal surfaces, each corresponding to one of the separated clusters of openings.

* * * * *